US009565498B2

(12) United States Patent
Waale

(10) Patent No.: US 9,565,498 B2
(45) Date of Patent: Feb. 7, 2017

(54) AUDIO DRIVER AND METHOD FOR TRANSFORMING AN ELECTRICAL SIGNAL INTO AIR MOVEMENT

(71) Applicant: Jens Waale, Warren Township, NJ (US)

(72) Inventor: Jens Waale, Warren Township, NJ (US)

( * ) Notice: Subject to any disclaimer, the term of this patent is extended or adjusted under 35 U.S.C. 154(b) by 474 days.

(21) Appl. No.: 14/098,932

(22) Filed: Dec. 6, 2013

(65) Prior Publication Data

US 2014/0112504 A1 Apr. 24, 2014

Related U.S. Application Data

(60) Provisional application No. 61/912,613, filed on Dec. 6, 2013.

(51) Int. Cl.

| | |
|---|---|
| ***H04R 25/00*** | (2006.01) |
| ***H04R 7/08*** | (2006.01) |
| *H04R 1/28* | (2006.01) |
| *H04R 9/02* | (2006.01) |
| *H04R 9/04* | (2006.01) |

(52) U.S. Cl.

CPC ..... *H04R 7/08* (2013.01); *H04R 1/288* (2013.01); *H04R 9/025* (2013.01); *H04R 9/048* (2013.01); *H04R 2209/041* (2013.01)

(58) Field of Classification Search

CPC combination set(s) only.
See application file for complete search history.

(56) References Cited

U.S. PATENT DOCUMENTS 1,862,582 A * 6/1932 Schlenker ..... H04R 7/08 181/163
3,783,202 A * 1/1974 Bobb ..... H04R 19/02 381/182

(Continued)

FOREIGN PATENT DOCUMENTS

GB 232600 6/1926
GB 232600 A * 6/1926 ..... H04R 9/00

OTHER PUBLICATIONS

"International Search Report and Written Opinion", issued in International Application No. PCT/US2014/068543, Mar. 10, 2015, Publisher: ISA/US.

*Primary Examiner* — Duc Nguyen
*Assistant Examiner* — Assad Mohammed
(74) *Attorney, Agent, or Firm* — Kaplan Breyer Schwarz & Ottesen, LLP

(57) ABSTRACT

An electromagnetic transducer for sound and ultrasound reproduction includes a substantially flat coil coupled to a diaphragm that is near to and facing the North or South side of a magnet. A very thin membrane made from a non-magnetic but electrically conductive material is independently mounted from the diaphragm and faces it. An AC signal in the coil results in diaphragm movement and "modulates" the permanent magnetic field. The modulating field generates a current in the membrane, which, upon further interactions, causes the membrane to move. The two independently moving surfaces each generate sound and result in an unusually flat SPL/frequency response, with unusually low narrow-band intensity variation and very low distortion. The transducer is also unique among electromagnetic transducers in that the force acting on the membrane is uniformly distributed over much of it, as in an electrostatic sound transducer.

23 Claims, 18 Drawing Sheets

(56) References Cited

U.S. PATENT DOCUMENTS

| | | | | |
|---|---|---|---|---|
| 6,687,381 | B2 * | 2/2004 | Yanagawa | H04R 7/08 381/386 |
| 7,433,485 | B1 * | 10/2008 | Diedrich | H04R 9/06 381/404 |
| 2002/0146139 | A1 * | 10/2002 | Oplinger | H04R 5/02 381/300 |
| 2010/0278371 | A1 * | 11/2010 | Hanada | H04R 7/10 381/398 |

* cited by examiner

AUDIO DRIVER AND METHOD FOR TRANSFORMING AN ELECTRICAL SIGNAL INTO AIR MOVEMENT

STATEMENT OF RELATED CASES

This case claims priority of U.S. Provisional Patent Application 61/912,613, which was filed Dec. 6, 2013 and which is incorporated by reference herein.

FIELD OF THE INVENTION

The present invention relates generally to sound reproduction, and more particularly to audio and ultrasound drivers.

BACKGROUND OF THE INVENTION

Sound waves exist as variations of pressure in a medium, such as air. The pressure variation results from the vibration of an object, which causes the surrounding medium to vibrate. The vibrating medium (i.e., air) then causes the human eardrum to vibrate, which the brain interprets as sound.

A loudspeaker (or "speaker") is an electroacoustic transducer that generates pressure variations in air in response to an electrical audio signal that it receives. The term "loudspeaker" may refer to individual transducers, known as audio "drivers," or to complete speaker systems consisting of an enclosure, speaker binding posts, a cross-over, and one or more audio drivers.

The most common type of audio driver is a dynamic driver. It uses a lightweight conically configured diaphragm (i.e., a cone), which is connected to a rigid supporting basket via a flexible suspension called a spider. The spider constrains a coil of fine wire, known as a voice coil.

When a "music" signal, typically from an audio amplifier and in the form of an alternating current ("AC"), is applied to the voice coil, a magnetic field is generated due to the flow of electric current. The field fluctuates as a function of the applied AC music signal. This fluctuating electromagnetic field interacts with the magnetic field of a fixed permanent magnet. This interaction results in a mechanical force (i.e., the Lorentz force). The force causes the coil and, hence, the attached cone, to move back and forth. The air pressure in front of the cone increases and decreases as a consequence of this movement. Pressure waves, which the human ear/brain interprets as "sound," are thereby generated in the air.

Drivers other than dynamic drivers are known and used for audio reproduction. Of particular relevance to this disclosure are planar drivers. Planar drivers are characterized by flat planar diaphragms (for moving air). One type of planar driver is the electrostatic transducer, the salient elements of which are depicted in FIG. 1. Electrostatic driver 100 includes three basic components: stators 102, diaphragm 106, and spacers (not shown).

Stators or grids 102 are electrically conductive metal sheets that are coated with an insulator. Stators 102 are perforated with holes 104. Diaphragm 106 is a very light weight plastic film, such as PET (commonly known as "Mylar") having a thickness 2-20 μm. The film is treated with an electrically conductive material, such as graphite. Diaphragm 106 is stretched taut and is disposed in a gap between stators 102. To help stiffen the stators and to prevent the diaphragm from contacting a stator, electrically-insulating strips of material (not depicted) are placed widthwise at intervals along each stator's length.

In operation, diaphragm 106 is charged to a fixed positive voltage by a high-voltage power supply. This generates a strong electrostatic field around the diaphragm. Stators 102 are driven by the electrical audio signal, which is delivered thereto from an audio amplifier via a step-up transformer. Stators 102 are anti-phase (i.e., one is positively charged and the other is negatively charged). The "sign" and amount of charge is a function of the electrical "music" signal. As a result, a uniform electrostatic field proportional to the audio signal is produced between both stators. This causes a force to be exerted on electrically charged diaphragm 106, causing it to move towards one or the other of the stators, depending on the charge of either. The moving diaphragm generates pressure variations in the air on either side of the diaphragm. Holes 104 are required so that these air pressure variations are projected outward beyond the stators. Diaphragm 106 is driven by two stators, one on either side of it, because the force exerted on the diaphragm by a single stator would be unacceptably non-linear, resulting in distortion.

A second type of planar driver is the magnetic driver. This driver works similarly to an electrostatic driver, except that the diaphragm is urged to movement due to a magnetic interaction rather than an electrostatic interaction. There are two types of magnetic drivers: ribbons and planar-magnetics.

FIG. 2 depicts ribbon driver 200. The ribbon driver includes two spaced-apart magnets 208A and 208B and "ribbon" 206.

The north pole of magnet 208A opposes the south pole of magnet 208B. Disposed between the two magnets in a side-by-side configuration is a flexible sheet of electrically conductive material known as a ribbon. Ribbon 206 is typically aluminum. The ribbon is very thin—essentially a foil—and it is pleated. Ribbon 206 is clamped at each end 210. There is slack in the ribbon such that it is under very little tension. The pleating serves at least two functions. It provides freedom of motion for the metal foil; that is, it serves as a suspension. It also provides a force-distribution function. More particularly, the Lorentz force (which arises as a consequence of magnetic interactions) acts on the edges of the ribbon as a function of frequency. The pleating helps to distribute the force so that it acts more evenly across the ribbon.

In operation, ribbon 206 receives the electrical (music) signal from an audio amplifier at contacts/terminals 212. Since the ribbon is conducting an electrical current, it generates a magnetic field. The magnetic field generated by ribbon 206, which varies as a function of the music signal, interacts with the non-varying magnetic field of permanent magnets 208A/B. Ribbon 206 is moved in either the plus or minus direction, perpendicular to the magnetic field between 208A/B, depending on which direction the alternating current of the amplifier's output is flowing.

The main advantage of a ribbon driver is that the ribbon has very little mass. Therefore, the ribbon can accelerate very quickly, providing excellent high-frequency response. But because it is so thin and light, the ribbon driver is exceedingly fragile and is very sensitive to outside pressure changes in the air.

Furthermore, ribbon drivers are generally limited to use as high frequency drivers since it is difficult to build a true ribbon driver large enough to handle lower frequencies. In particular, the pleated shape is easily damaged by its own weight if it's too large. Also, it can be damaged by excessive excursion, which can stretch and flatten the pleats. When this happens, the ribbon sags in the gap between the magnets and performs poorly. As a consequence, these drivers tend to be small and limited to high frequencies, wherein excursions are minimal and the ribbon can readily support its own weight.

Also, a true ribbon speaker presents a problematically low impedance to the power amplifier that drives it. The small ribbon presents little resistance to current flow, which, if not addressed, would behave like a short circuit to the amplifier. Even if the amplifier itself is not damaged, or doesn't shut down for protection, few amplifiers perform well when presented with such a low impedance load (about 0.1Ω). Most ribbons drivers incorporate a step-down transformer to mitigate this problem. Unfortunately, as with electrostatic speakers, the transformer itself can limit the ultimate performance of the ribbon driver and adds to its cost.

Unlike the ribbon driver in which the diaphragm is in a side-by-side arrangement with respect to the magnets, in a planar magnetic driver, the magnets are located in front of and, in some cases, also in back of the diaphragm. A thin flexible plastic, such as Mylar, typically serves as the diaphragm.

In some planar magnetics, a thin, flat, conductive foil is glued onto the diaphragm. In some other planar magnetic drivers, metal wire, rather than conductive foil, is glued to diaphragm. The electrically conductive element (i.e., foil or wire) conducts the amplifier's output (music) signal and creates an electromagnetic field that varies with the music signal. The varying electromagnetic field interacts with nearby permanent magnets giving rise to the Lorentz force that causes the diaphragm to move towards or away from the magnets. The planar magnetic driver can operate satisfactorily at much lower frequencies than a ribbon driver.

A cutaway view of planar magnetic driver 300 with wire is depicted in FIG. 3A. Driver 300 includes stators 302, diaphragm 306, permanent magnets 308A/B, and electrically conductive trace(s) or wire(s) 314.

As depicted in FIG. 3A, plural magnets 308A are disposed on one stator 302 and plural magnets 308B are disposed on the opposing stator. The magnets are arranged so that, along a stator, the north and south poles of adjacent magnets alternate. Magnetic field lines exit north poles and enter south poles. Stators 302, which are steel, close the magnetic circuits and secure magnets 308A/B in a proper orientation. The component of the vector of the magnetic field B that is useful (for generating movement) lies in the plane of diaphragm 306.

As in an electrostatic driver, diaphragm 306 is disposed between the two stators 302. More precisely, in driver 300, diaphragm 306 is disposed in a gap between opposing magnets 308A/B on the stators. The diaphragm is typically formed from Mylar or a material having characteristics similar thereto. Bonded to diaphragm 306 is one or more lengths of wire 314 arranged as one or more elongated coils. As depicted in FIG. 3B, the "coil" is stretched out along the diaphragm such the wire or electrically-conductive trace (hereinafter simply "wire") 314 runs lengthwise, in parallel to bar magnets 308A/B.

In operation, an amplified electrical (music) signal is brought to the speaker's binding posts 312, which are electrically coupled to wire(s) 314. The current (I) flowing through the wire(s) generates a magnetic field (B) that varies as a function of the applied electrical signal. This fluctuating magnetic field interacts with the magnetic fields of the permanent magnets. A (Lorentz) force (F) results from the interaction; the force varies in magnitude as a function of the amplitude of the music signal and varies in direction as a consequence of the direction in which the current flows through wire(s) 314. The directional relationship between current (I), magnetic field (B), and force (F), as given by Flemings "left hand rule," is depicted in FIG. 3A.

The resulting (Lorentz) force F is perpendicular to diaphragm 306, in one direction or the other. This force causes the wire(s) 314 and diaphragm 306 to move toward one set of magnets or the other. When the current changes direction, the direction of force changes 180 degrees. Wires 314 are arranged on the surface of diaphragm 306 so that the resulting force moves all of the wires (and hence diaphragm 306) in the same direction.

Because wires 314 are strongly bonded to diaphragm 306, and because wires 314 cover a major portion (about 80 percent or more) of the diaphragm's surface, the diaphragm moves back and forth like a piston. This movement, which is ultimately a consequence of the changing electrical (music) signal, vibrates the surrounding air, thereby creating a pressure (sound) wave. The pressure wave passes through openings 304 in both stators 302.

Planar magnetic drivers are relatively inefficient, with a low force-per-square-inch acting on the diaphragm. The active magnetic force is a line force, which can result in irregular movement of the diaphragm. Efficiency can be improved through the use of stronger magnets, but this exacerbates any tendency toward irregular diaphragm movement due to the nature of the line force, among other things. The driver performs with reasonable levels of distortion, but the frequency spectrum can have some sharp peaks in sound pressure level ("SPL").

There is, as such, room for improvement in audio-driver technology. In particular, it would be advantageous to have a planar driver that has a broader frequency range of operation than existing planar drivers and that is more accurate with very low distortion over the full operating frequency range.

SUMMARY OF THE INVENTION

The present invention provides a way to reproduce, with an unusually flat frequency response (i.e., SPL vs. frequency) and very low distortion, the mid-range (300 Hz to about 3 kHz) and higher frequencies (3 kHz to 20 kHz) of the audio spectrum.

The illustrative embodiment of the present invention is an audio speaker comprising a variant of a planar-magnetic driver. Unlike prior-art audio drivers, an audio driver in accordance with the illustrative embodiment includes two dissimilar interacting movable surfaces that are responsible for generating sound. One of the surfaces is directly driven by the electrical (music) signal; the other is not. The driver avoids some of the drawbacks of prior-art planar drivers and, in fact, drivers of all types.

In the illustrative embodiment, the audio speaker includes a frame/partial enclosure for supporting the driver and speaker "binding posts." The binding posts are connectors that electrically couple speaker wires, which convey a music signal in the form of an AC signal, to the driver. The driver includes a magnet, a diaphragm and a coil, a membrane, and structures for supporting those elements.

Focusing on the driver, the coil comprises an electrically-conductive material, such as a strand of copper or silver wire. In the illustrative embodiment, the coil includes multiple loops or "turns" of wire in a substantially flat planar arrangement, wherein each turn is partially overlapped by a number of nearest turns. The coil is attached to the diaphragm, which, in the illustrative embodiment, is a thin, strong, electrically insulating, non-magnetic material, such as a plastic or a cellulosic material. The diaphragm is fastened to a first support in such a way as to create an air-tight seal between that support and the diaphragm.

The diaphragm, with attached coil, is one of the movable surfaces of the driver; the membrane is a second movable surface. The membrane is electrically conductive but non-magnetic. In the illustrative embodiment, the membrane is a foil comprising a non-mu-metal, such as aluminum, gold, silver, copper, platinum, etc., or combinations of such metals. The foil is attached to a second support.

The driver elements are arranged as follows. The magnet is disposed to one side of the diaphragm, preferably the side of the diaphragm closest to the coil. The membrane is located on the other side of the diaphragm. There is a gap between the magnet and the coil/diaphragm and there is also a gap between the coil/diaphragm and the membrane.

The surface of the magnet and the diaphragm/coil are substantially parallel to one another. In the illustrative embodiment, the membrane is not parallel to the diaphragm; rather, one end of the membrane is relatively closer to the diaphragm and the other end is relatively further therefrom. The profile of this "tapered" gap can be linear or curved, but a curved profile will typically result in a flatter driver response (i.e., SPL versus frequency) than a linear profile. In some alternative embodiments, such as those in which the driver is intended to operate over a narrow frequency range, the membrane is parallel or nearly parallel to the diaphragm.

In operation, an electrical (audio) signal that appears at the outputs of an audio amplifier is delivered (e.g., via speaker cables, binding posts, internal wiring, any intervening electronics) to the coil that is attached to the diaphragm. The electrical music signal flows as a current through the coil. The flow of current will, of course, generate a magnetic field that varies with the music signal. This varying magnetic field interacts with the magnetic field of the nearby magnet. The diaphragm/coil reacts by moving towards or away from the magnet as a consequence of the (Lorentz) force arising from the interaction of these fields.

The varying magnetic field generated by the current will "modulate" the magnetic field that is generated by the magnet. For clarity, the field generated by the magnet and the varying field generated by the coil are treated herein as being distinct fields; of course, there is only a single resultant magnetic field when two or more fields interact, the resultant field being the sum thereof.

As a consequence of its exposure to the modulating magnetic field, "eddy" currents are induced in the membrane. Eddy currents are created when a non-magnetic electrical-conductor experiences a change in the intensity or direction of a magnetic field at any point within the electrical conductor.

The eddy currents in the membrane generate a magnetic field that interacts with the magnetic field generated by the magnet and the varying magnetic field generated by the coil. These interactions generate a (Lorentz) force that urges the membrane to move as a function of the changing magnetic field. The resulting motion is related to the motion of the diaphragm.

It will be appreciated that, in the illustrative embodiment, since both the diaphragm and the membrane are moving, they both contribute to generating sound. As discussed in further detail later in the Detailed Description, in the illustrative embodiment, the relative contributions of the diaphragm and the membrane to the overall sound pressure level being generated varies as a function of frequency and as a function of the distance between the diaphragm and the membrane. The fact that the distance between the diaphragm and the membrane is not constant provides an advantageous flexibility for manipulating the frequency response and other performance parameters of the driver.

The planar drivers disclosed herein operate in a way that is quite distinct from prior-art planar drivers, be they electrostatic, ribbon, or planar magnetic. This difference in operating principle gives rise to many functional, operational, and structural differences between embodiments of the present invention and the prior art. Some of these differences include, without limitation, that in some embodiments of drivers in accordance with the present invention:

- Two independently suspended, mutually interacting, movable surfaces each comprising a different material are used to generate sound. Most planar-magnetic drivers in the prior art use a single movable surface comprising, for example, Mylar. In the rare instance that a prior-art planar-magnetic driver uses two movable surfaces, those surfaces are made of the same material.
- Two independently suspended, mutually interacting, movable surfaces, wherein one of the surfaces is driven directly by the musical signal (i.e., the music signal is delivered to a coil attached to the one surface) and the other surface is not directly driven. If prior-art planar-magnetic drivers use two movable surfaces, both of those surfaces are directly driven by the music signal.
- A movable surface that is not parallel to the surface of the magnet is included. In prior-art planar-magnetic drivers, the movable surface is parallel to the surface of the magnets.
- One movable surface is parallel to the surface of the magnet(s) and a second movable surface is not. If prior-art planar-magnetic drivers use two movable surfaces, those surfaces are parallel to one another and to the magnet(s).
- One of the movable surfaces is an electrically conductive, non-magnetic foil that does not directly conduct an electrical signal. In prior-art ribbon drivers, which incorporate an electrically conductive, non-magnetic foil, the foil is driven directly by the electrical (music) signal. In prior-art electrostatic drivers, the diaphragm does not conduct the music signal; however the diaphragm is electrostatically charged to a high voltage to interact with the varying electrostatic field generated by the stators, which do conduct the music signal.
- Movement of one of the movable surfaces results, in part, from the generation of eddy currents in that movable surface. The eddy currents generate a magnetic field, which interacts with the other magnetic fields. Forces arising from that interaction cause such movement. No prior-art planar driver generates eddy currents in a movable surface to cause that surface to move.
- Two different forces are responsible for the movement of the membrane.
- The membrane is driven to movement partially by air pressure and partially by forces arising from magnetic/electrical interactions.
- The relative contributions of air pressure and electrical/magnetic force interactions to movement of the membrane varies; the lower the frequency of the sound being reproduced, the greater the relative contribution of air pressure to moving the membrane. The greater the frequency of sound being reproduced, the greater the relative contribution of magnetic force to movement of the membrane.
- The wires for carrying the music signal that are attached to a diaphragm are not substantially parallel to the magnet. Although they are in a plane that is parallel to the surface of the magnet, the alignment of wires within that plane is not parallel to the orientation of the magnet. In prior-art planar magnetic drivers, the current-carrying wires are oriented so that they are parallel to magnets. (See, e.g., FIG. 3A.)

The component of the vector of the permanent magnetic field that is not parallel to diaphragm (i.e., $B_y$, see FIG. 12A) is utilized to move the membrane. Prior-art planar-magnetic drivers utilize only the component of the vector of the permanent magnetic field that is parallel to the diaphragm (i.e., $B_x$) for moving the movable surface.

The component vector of the permanent magnetic field that is parallel to the diaphragm (i.e., $B_x$, see FIG. 12A) is utilized to move the diaphragm and the component of the vector of the field that is orthogonal thereto, $B_y$, is used to move the membrane.

The modulated magnetic field of embodiments of the invention will generate a force that is virtually uniformly distributed across the membrane. There is no prior-art planar driver based on a magnetic operating principle (i.e., planar-magnetic and ribbon drivers) in which the (Lorentz) force is caused to act uniformly on the movable surface (diaphragm). Only an electrostatic driver operates with a unified force on the moveable surface.

Many benefits accrue from the inventive driver design. These benefits include, among others:

The driver can be exceedingly efficient for a planar driver; it is about two orders of magnitude (i.e., about 100×) more efficient than an electrostatic driver.

The driver exhibits very low distortion over the usable frequency band (less than 0.1 percent).

The operating frequency range of the driver is very large; it can operate at frequencies as low as a few hundred Hz to as high as 200 kHz.

The driver is very tolerant of structural variations; for example, the gap between the permanent magnet and the coil/diaphragm can vary by up to about 40% with no significant audible affect.

The mutual interaction between the diaphragm/coil and membrane has been observed, unexpectedly, to compensate for aberrations in coil placement and the misalignment of other elements of the driver.

The profile of the gap between the diaphragm and the membrane can be varied to provide, with a flat frequency response, a relatively more limited operating frequency range at very high efficiency or a relatively broader operating frequency range at somewhat lesser efficiency. For the former operating mode, the diaphragm and membrane tend to be parallel to one another, or more nearly parallel, than for the latter operating mode.

The response of the driver can be easily altered to emphasize (i.e., increase the SPL of) relatively high frequencies, thereby deviating from a flat SPL versus frequency response, by altering the profile of the gap between the diaphragm and the membrane.

The driver has very low inductance and, as such, at high frequencies, the inductance remains at acceptable values.

By comparison with the prior art, the driver has a large number of parameters that can be altered to achieve a desired performance for the driver.

The membrane, although only microns thick, is relatively insensitive to changes in ambient air pressure (e.g., external sounds, etc.). One side of the membrane faces the diaphragm, which effectively functions as a wall. As a consequence, the membrane operates predominantly as a monopole unit. Prior-art ribbon, planar-magnetic, and electrostatic drivers typically operate as dipoles and, as a consequence, are relatively sensitive to changes ambient air pressure.

By virtue of its operating frequency, it is anticipated that embodiments of the audio driver described herein will be used to great effect as the high-frequency driver ("tweeter") in a multi-driver audio speaker. Such an audio speaker may include one or more conventional "woofers" (low-frequency drivers for reproducing frequencies between about 40 to about 200 Hz), one or more conventional midrange drivers (typically for reproducing frequencies between about 200 to 3000 Hz), and one or more tweeters (typically for reproducing frequencies between about 2 kHz to about 20 kHz) in accordance with the present teachings.

By adjusting certain parameters of the driver design, the audio drivers disclosed herein can be designed to function as midrange drivers. Thus, an audio speaker may include one or more conventional woofers, one or more midrange drivers consistent with the present teachings, and one or more tweeters consistent with the present teachings.

The challenge for any audio driver is not simply to reproduce a range of frequencies, but to do so with low distortion and, perhaps most importantly, with a "true" flat response. The use of the word "true" means that there are no narrow peaks or dips in the signal. Such peaks and dips are normally "ignored" or "overlooked" in manufacturers' promotional literature by averaging the SPL response signal. Thus, ideally, the sound pressure level that the driver can generate as a function of the frequency being reproduced should vary as little as possible across the driver's operating frequency range. In other words, a driver ought to be able to reproduce the lowest frequencies that it is intended to reproduce with the same perceived "loudness" as the highest frequencies it is intended to reproduce, and the same as all frequencies in between.

No driver will generate a perfectly flat response over the audio range. Most manufacturers of high-quality audio speakers will reference a frequency range of operation (e.g., 45 Hz to 20 kHz, etc.) that varies by +/−3 dB over that spectrum. As a consequence, the speaker output at two different frequencies can vary by as much as 6 dB over that frequency range. A 6 dB variation equates to a doubling (100% increase) in sound pressure and about a 50 percent difference in perceived "loudness" (the latter being a psychoacoustic "measure" that is somewhat subjective). A 3 dB difference in sound pressure is estimated to correlate to a perceived increase in loudness of about 20 percent. A 1 dB difference in sound pressure is considered to be not perceptible to a human.

A driver, intended for operation as a tweeter, was fabricated in accordance with the present teachings. Testing of the driver showed an unsmoothed (no averaging) variation of less than +/−1.5 dB between 2 kHz and 20 kHz, with distortion less than 0.1% at any frequency above 2 kHz. Narrow peaks and dips in the response curve were measured at less than +/−1 dB.

DETAILED DESCRIPTION

Figure 1:
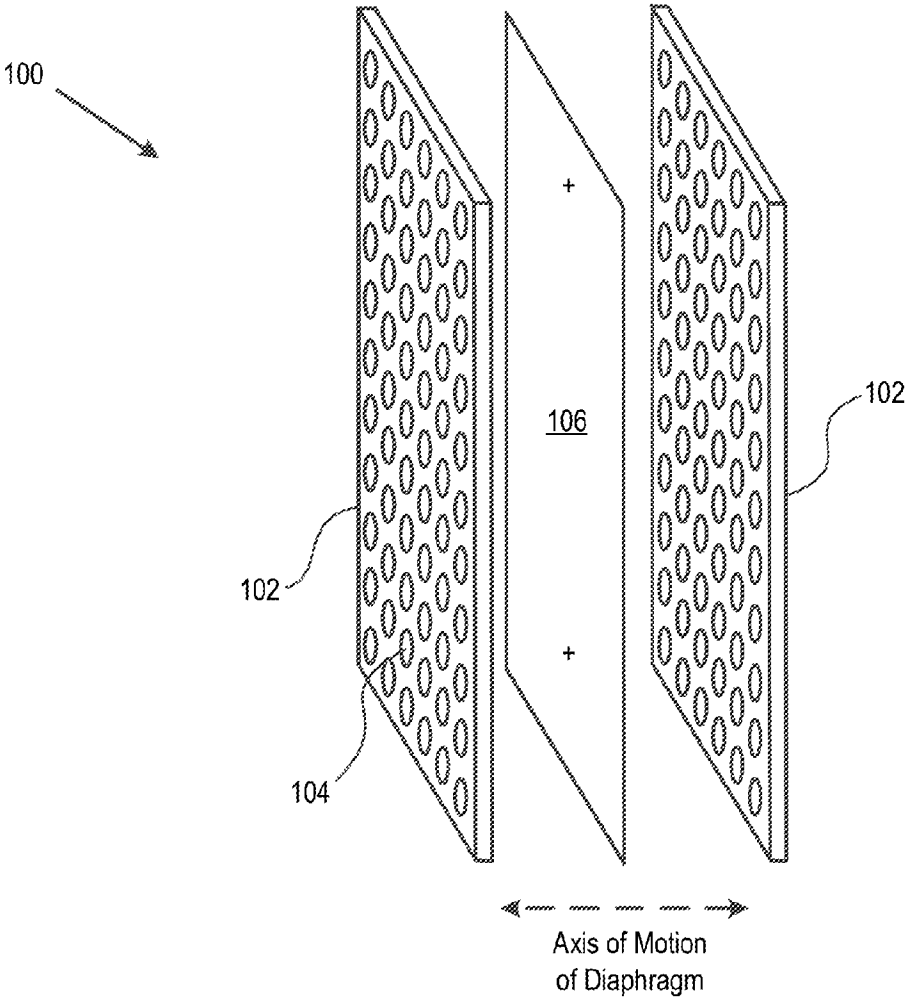
FIG. 1 PRIOR ART
FIG. 1 depicts a prior-art electrostatic audio driver.
Figure 2:
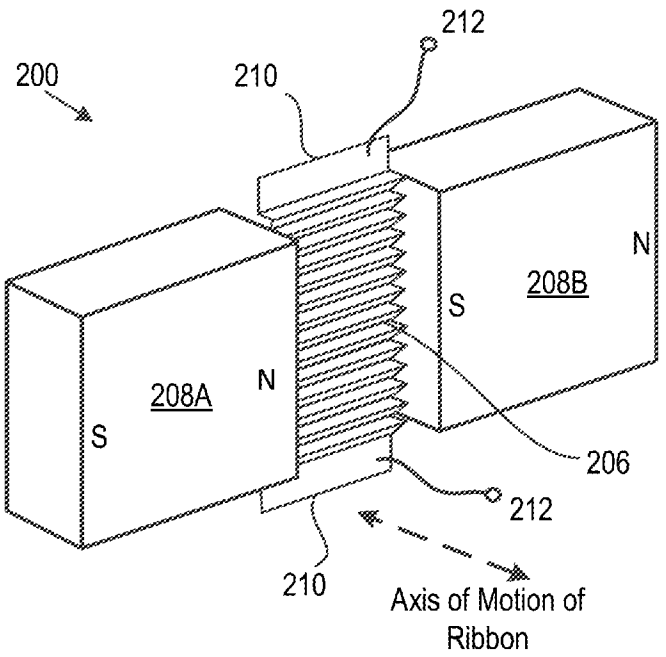
FIG. 2 PRIOR ART
FIG. 2 depicts a prior-art ribbon audio driver.
Figure 3A:
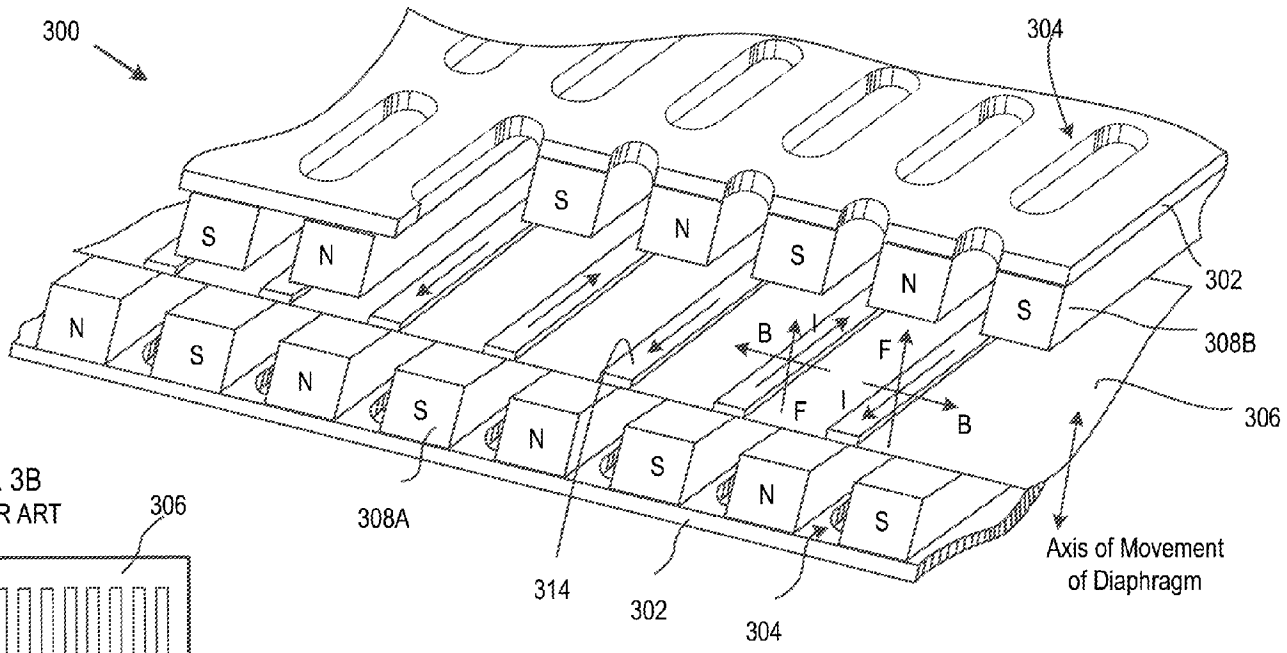
FIG. 3A PRIOR ART
FIGS. 3A/3B depict a prior-art planar magnetic audio driver.
Figure 3B:
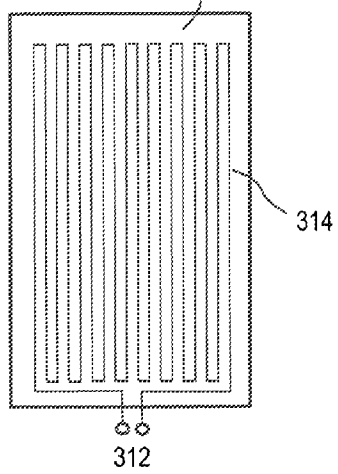
FIG. 3B PRIOR ART

Some embodiments of the invention provide a driver, or audio speaker including at least one driver, that can reproduce, with an unusually flat frequency response and very low distortion, the mid-range and/or higher frequencies of the audio spectrum. In the illustrative embodiment, the driver is configured as a tweeter with an operating frequency range of about 2 kHz to about 20 kHz. In some other embodiments, the driver can be configured as a mid-range driver with an operating frequency range of about 300 Hz to about 3000 kHz. In yet some additional embodiments, the driver operates at ultrasonic frequencies, such as above 20 kHz and as high as about 200 kHz. It will be understood that drivers in accordance with the present teachings can operate at frequencies less than 300 Hz, but there are other driver designs that will do so with better efficiency.

As indicated in the Summary section, audio drivers in accordance with the present teachings are quite distinct from prior-art audio drivers. A salient distinction is that in the illustrative embodiment, the driver incorporates two dissimilar interacting movable surfaces, only one of which is directly driven.

As used in this description and the appended claims, the phrase "directly driven," when referring to a movable surface, means that an electrical charge is conducted, via an electrical conductor (e.g., wire, metal trace, etc.) to the movable surface itself or to an electrical conductor that is disposed on the movable surface. The electrical conductor conveying the electrical charge can be directly physically attached to the movable surface (or to the conductor on the movable surface) or there can be intervening electrically conductive elements between the charge-carrying conductor and the movable surface. The commonality is that there is an electrically conductive pathway for charge to be delivered from its source to a movable surface (or conductor disposed thereon). The electrical charge can be in the form of a "signal;" that is, it can be "information bearing," such as the electrical music signal. Thus, in a ribbon tweeter (prior art), the movable surface (the foil) receives the electrical music signal, so, according to the definition, the foil is "directly driven." In a planar magnetic driver having an electrical conductor (strips of foil or wire) on a (mylar) diaphragm, the electrical conductor receives the electrical music signal and so, according to the definition, the diaphragm is "directly driven."

A movable surface can also be "directly driven" by a non-information-bearing electrical charge. For example, in the case of an electrostatic driver, the movable surface (mylar diaphragm treated with an electrically conductive material) is charged to a positive voltage by a high voltage power supply. Since that movable surface receives the electrical charge, it is, according to the definition, "directly driven."

As used in this description and the appended claims, the phrase "substantially parallel," when referring to a geometrical relationship between two surfaces, means that the surfaces deviate from true parallel by about 5 percent or less.

Another unique feature of some embodiments is that the movable surfaces are not parallel to one another. In such embodiments, the coil/diaphragm is typically substantially parallel to the facing surface of one or more permanent magnets that are part of the driver while the membrane is not parallel to diaphragm (or the magnet(s)). Furthermore, in the illustrative embodiment, the membrane "curves" away from coil/diaphragm; that is, the gap between these two surfaces tapers in non-linear fashion.

Also, unlike prior-art planar drivers, the membrane is urged to movement due to forces arising from both (1) magnetic/electric field interactions and (2) air pressure that is generated by movement of the diaphragm. These are but a few distinctions; others have been previously noted and still further differences will become clear as the description of the illustrative embodiment and alternative embodiments proceed.

The operation of the illustrative embodiments of the invention involves magnetism, among other phenomena. Magnetism is a phenomenon whereby an electric current generates a magnetic field, and other electric currents that flow in that magnetic field experience a displacing force. Electric currents can exist in a variety of forms. For example, and without limitation, an electric current can be generated by applying an electric power source to a wire, resulting in an electric current flowing through the wire. Currents can be induced in an electrical conductor by an external magnetic field. In all such cases, electric currents generate magnetic fields and are affected by magnetic fields generated by other currents.

A permanent magnet can be modeled as a piece of material wherein the structure of the material contains permanent atomic currents (also called Ampèrian currents) that generate magnetic fields without the need of a power source to sustain the currents. When two permanent magnets are brought near one another, the currents in one magnet are affected by the magnetic field of the other magnet and vice versa, resulting in, for example, attraction, or repulsion, or more complex force patterns, depending on the relative positions of the magnets. A full description of the interaction requires solving Maxwell's equations and accounting for the interaction of each part of each electric current with the overall magnetic field resulting from the contribution of all the other currents. However, in many practical situations such level of detail is not necessary. It is common in the art to describe an interaction between two magnets by saying that "the two magnetic fields interact" with one another, resulting in attraction, or repulsion, or whatever pattern of forces occurs. In this specification, such simplified description is used, for ease of explanation, wherever the more detailed description is not necessary.

Figure 4:
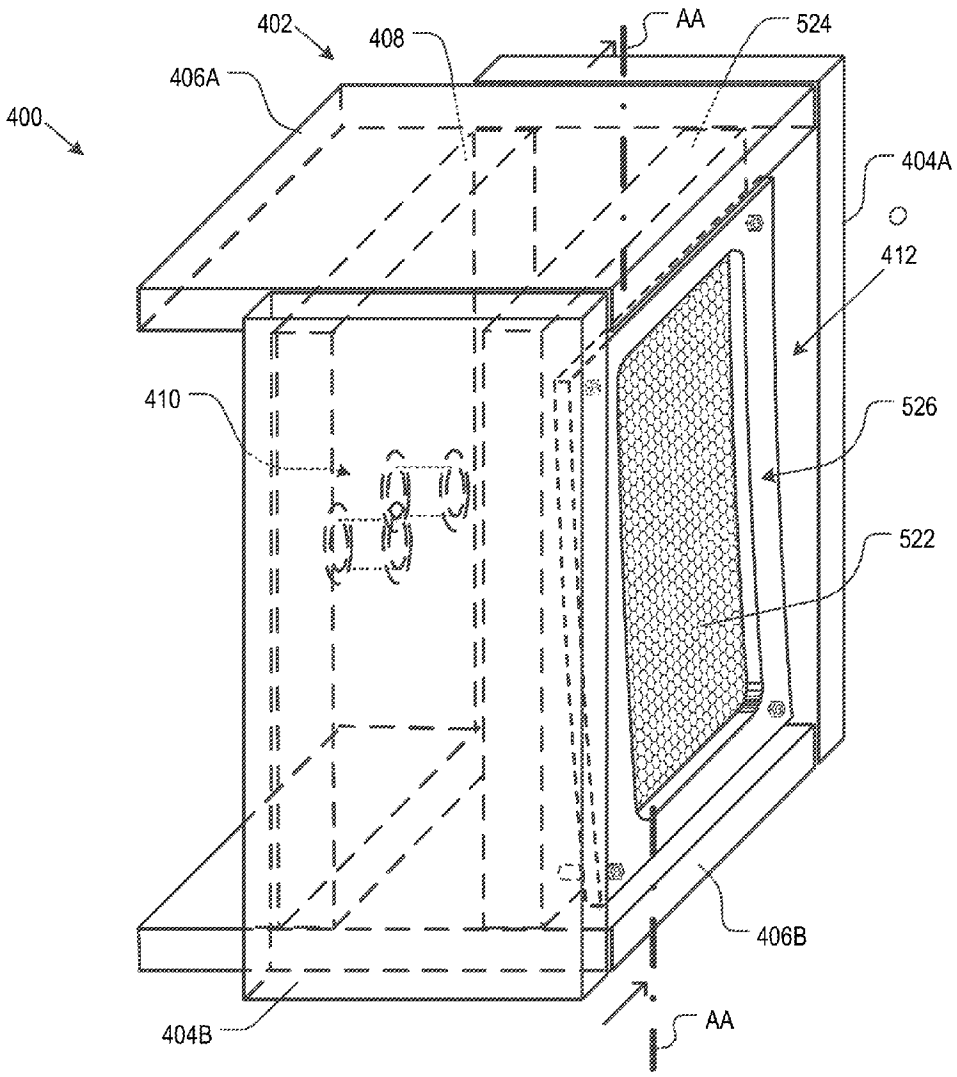
FIG. 4 depicts an audio speaker comprising an audio driver in accordance with the illustrative embodiment of the present invention.

Audio Speaker. FIG. 4 depicts audio speaker 400 in accordance with the illustrative embodiment of the present invention. Audio speaker 400 includes enclosure 402, speaker terminals or binding posts 410, and driver 412.

In the illustrative embodiment, enclosure 402, which only partially encloses driver 412, includes left side panel 404A, right side panel 404B, top panel 406A, bottom panel 406B, and back panel 408. In the illustrative embodiment, the panels are made of polypropylene and are attached to one another via fasteners, e.g., screws, etc. In other embodiments, other rigid materials can be used to form enclosure 402; for example, other types of plastic, aluminum, wood, MDF, acrylic, and other materials commonly used by speaker manufacturers can suitably be used. As will be appreciated by those skilled in the art, the approach used to attach the panels is likely to vary as a function of materials used, wherein certain approaches will be more or less appropriate as a function of the materials of construction of enclosure 402.

It is to be understood that enclosure 402 is illustrative of one arrangement for supporting audio driver 412; many others will occur to those skill in the art after reading the present disclosure. For example and without limitation, in some other embodiments, driver 412 can be supported in: (i) an enclosure having a different shape than that shown in FIG. 4; (ii) a one-piece enclosure; (iii) an enclosure that is large enough to accommodate additional audio drivers and/or cross-over electronics; or (iv) any combination of (i) through (iii).

Speaker terminals or binding posts 410 are fastened to back panel 408. The binding posts, which are well known to those skilled in the art, are configured to receive the positive and negative leads of speaker wires carrying an electrical (audio) signal. The signal can be received directly from an amplifier, or alternatively, can be the output of a passive or active crossover that segregates an audio signal into portions having different frequency ranges. In the latter situation, the different portions are directed to an audio driver that is best suited for reproducing such frequencies. For example, audio speaker 400 would typically receive frequencies of about 2 kHz and higher. In some other embodiments, audio speaker 400 or driver 412 thereof is integrated with other drivers in such a way that speaker wire carrying the audio signal is hardwired to audio speaker 400 or driver 412.

Audio Driver. A portion of audio driver 412 is visible in FIG. 4; in particular, diaphragm support 524, membrane support 526, and membrane 522. In the illustrative embodiment, nothing obscures membrane 522, which is "exteriormost" sound-generating surface. Membrane 522 is, however, very delicate; hence, in some other embodiments, an acoustically-transparent structural grid (e.g., an aluminum mesh, etc.) is disposed in front of membrane 522 to prevent damage from inadvertent contact.

In some embodiments, fibrous material (not depicted) is disposed between back panel 408 and diaphragm support 524. Such material, which is commonly used in audio speakers, provides "damping" of the pressure waves propagating between back panel 408 and diaphragm support 524. The use of damping materials can improve audio performance of the driver 412. Those skilled in the art will be able to select and use suitable damping material, as desired, to obtain a desired performance from audio speaker 400.

Figure 5:
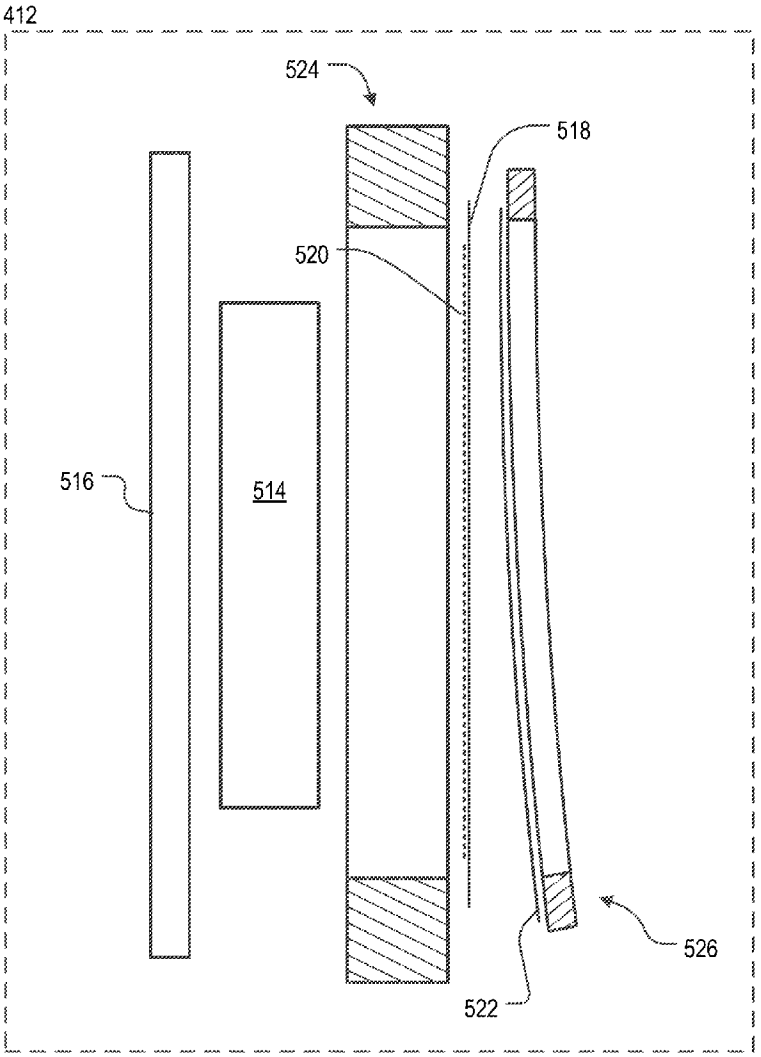
FIG. 5 depicts a side cross-sectional exploded view of the salient elements of the audio driver used in the audio speaker of FIG. 4.

Driver 412 is now described in further detail in conjunction with FIG. 5, which depicts an "exploded" side cross-sectional view thereof along the line AA in FIG. 4 in the direction shown. Driver 412 comprises magnet 514, magnet support 516, diaphragm 518, coil 520, membrane 522, diaphragm support 524, and membrane support 526, arranged with respect to one another as shown.

In the illustrative embodiment, driver 412 includes a single magnet 514. As used in this disclosure and in the appended claims, the term "magnet" includes an electromagnet or a permanent magnet. In the illustrative embodiment, magnet 514 has a rectangular shape and is a rare earth magnet, such as a neodymium ($Nd_2Fe_{14}B$) magnet, samarium-cobalt ($SmCo_5$) magnet, etc. In some other embodiments, more than one magnet can be used, and/or the shape of the magnet(s) can be non-rectangular, and/or the magnet(s) can be other than a rare earth magnet (e.g., alnico, Sr-ferrite, etc.). For embodiments in which a single magnet is used, magnet 514 preferably has a $BH_{max}$ (the energy stored in the magnet, often referenced "magnet performance" or "maximum energy product") of at least about 250 $kJ/m^3$. For this reason, embodiments that use a magnet other than a rare earth magnet will typically use more than one magnet to provide a suitably strong magnetic field.

Figure 6A:
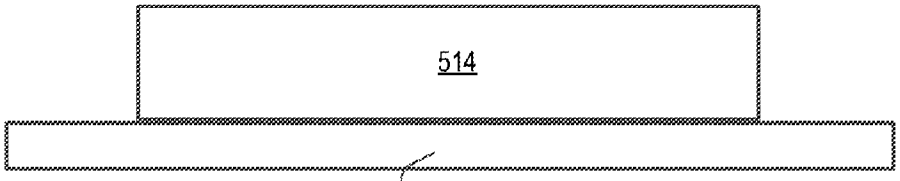
FIG. 6A depicts a top sectional view of the permanent magnet coupled to the magnet support in the audio driver of FIG. 5.

With continuing reference to FIG. 5, and also with reference to FIG. 6A (top view), magnet support 516 supports or "holds" magnet 514 and, as a function of materials choice, it can be used to alter the strength and shape of the magnetic field emanating from magnet 514.

In the illustrative embodiment, magnet support 516 comprises steel. As a consequence, magnet 514 is magnetically attracted to magnet support 516, such that no coupling elements (e.g., clasps, etc.) or bonding materials are required to couple the magnet to the magnet support. In some embodiments, regardless of whether or not magnet support 516 is magnetic, magnet 514 is securely coupled thereto via any suitable arrangement therefor.

The presence of steel (or other magnetic materials) in the vicinity of magnet 514 affects the magnet's magnetic field. That being the case, selecting one material having a first magnetic permeability versus another material having a second magnetic permeability for use as support 516 will alter the magnetic field of magnet 514.

Figure 6B:
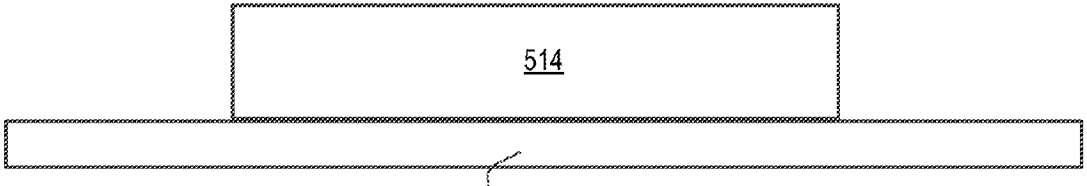
FIG. 6B depicts a top sectional view of the permanent magnet coupled to a first alternative embodiment of the magnet support in the audio driver of FIG. 5.
Figure 6C:
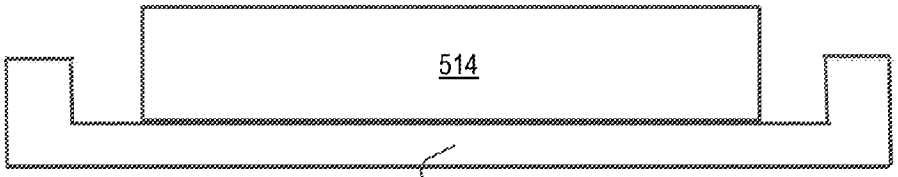
FIG. 6C depicts a top sectional view of the permanent magnet coupled to a second alternative embodiment of the magnet support in the audio driver of FIG. 5.

The magnetic field of magnet 514 can also be influenced by altering the geometry of magnetic support 516. Such alterations to geometry include, without limitation, (i) changing the width of the magnet support relative to the width of magnet 514 and/or (ii) changing its shape. FIG. 6B depicts magnet support 516', which is wider than magnet support 516. FIG. 6C depicts magnet support 516", wherein the ends of the support extend orthogonally from the main portion of the support, forming a truncated "u-shape". As will be appreciated by those skilled in the art, magnet supports 516, 516', and 516" will each affect the magnetic field of magnet 514 in a different and predictable way. As discussed later in this specification, diaphragm 518/coil 520 moves as a consequence of the force resulting from the interaction of magnetic field of magnet 514 with the field generated by the current moving though coil 520. Therefore, the resulting force on the diaphragm will differ for each different magnet support 516, 516', and 516" in ways understood by those skilled in the art.

Although FIG. 5 depicts a solid magnet, it will be clear to those skilled in the art, after reading this disclosure, how to make and use alternative embodiments of the present invention wherein the magnet has holes, or the single relatively larger magnet is, instead, implemented as an array of relatively smaller magnets. These alternatives will present a reduced "impedance" to sound waves (i.e., the air will move more freely as the diaphragm vibrates) compared to a solid magnet that fills much of the available space. The ability to alter impedance in such fashion can be advantageous for providing different performance parameters.

With continued reference to FIG. 5, diaphragm 518 is a thin, strong, electrically insulating, non-magnetic material, such as a plastic (e.g., Dupont Co. Tyvek® brand spunbond olefin fiber, etc.) or a cellulosic material.

Figure 7B:
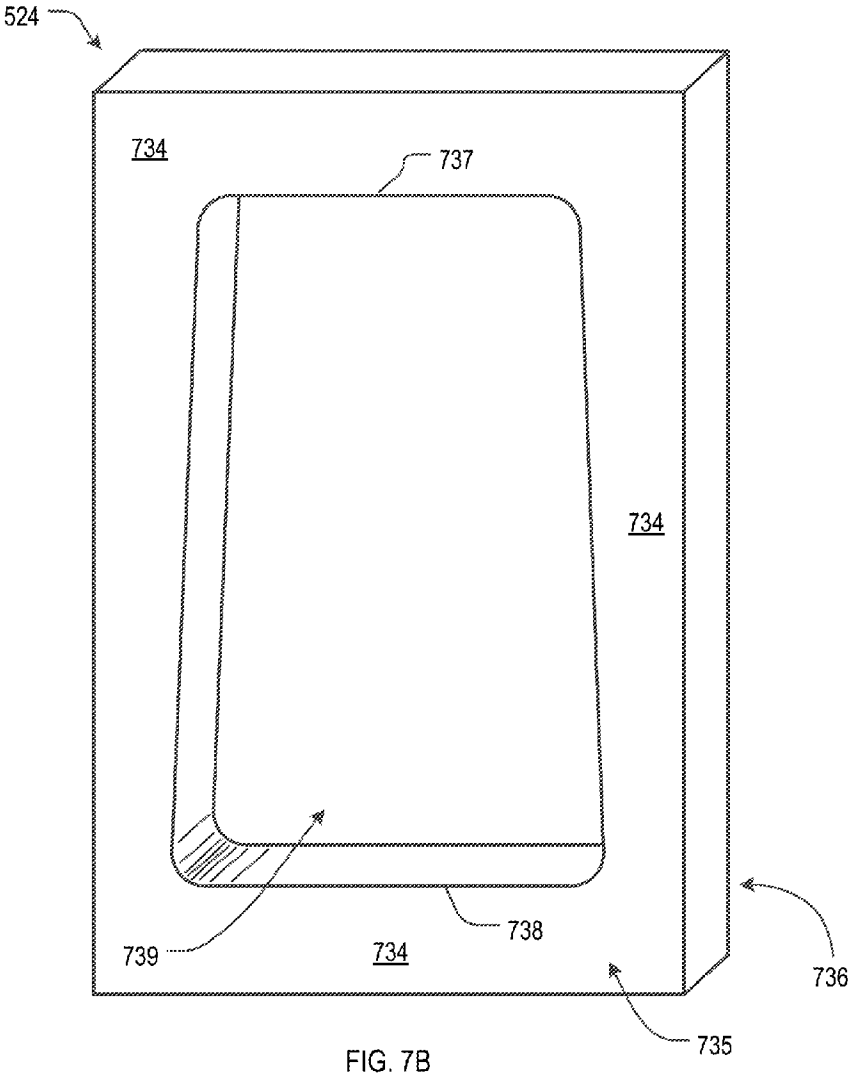
FIG. 7B depicts a perspective view of a diaphragm support of the audio driver of FIG. 5.
Figure 7A:
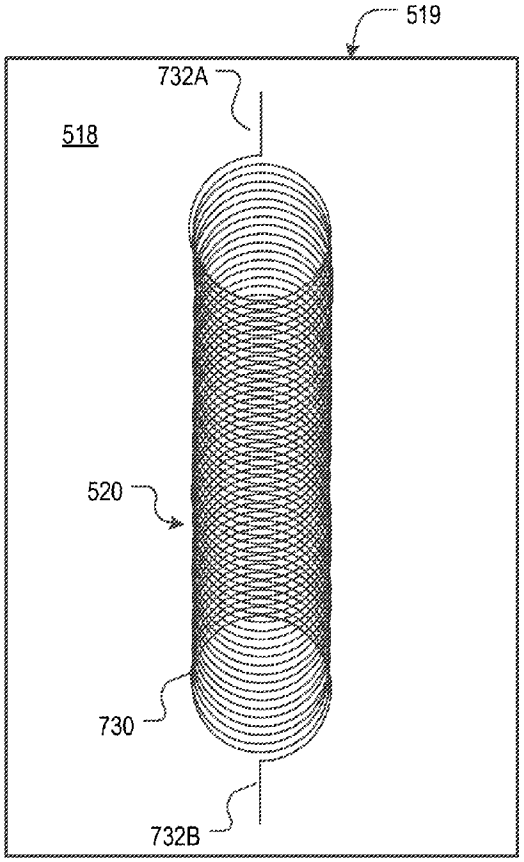
FIG. 7A depicts a view of a major surface of the diaphragm with the coil attached in the audio driver of FIG. 5.

Referring now to FIG. 7A, in the illustrative embodiment, diaphragm 518 has a rectangular shape defined by perimeter 519. In some other embodiments, the diaphragm has a quadrilateral form other than rectangular, or a polygonal form other than four-sided, a circular form, or an irregular form.

Coil 520 is attached, such as by glue, to diaphragm 518. The coil comprises an electrically-conductive material, such as a strand of electrically-insulated (i.e., via sheathing) copper or silver wire, etc. The coil includes multiple loops or "turns" 730 of wire in a substantially flat planar arrangement on a surface of diaphragm 518. In the illustrative embodiment, a single strand of conductor is used, terminating at end 732B and end 732A. In some other embodiments, multiple strands of conductor are used; that is, there are multiple coils 520. In embodiments in which multiple coils are used, they can be electrically connected in parallel or in series, with predictable effects on impedance, etc. The coil is referred to as being "substantially flat planar" because each turn of wire is partially overlapped by a number of nearest turns. Consequently, the coil is not perfectly flat or "planar." Yet, the coil is effectively flat, especially when compared to the (voice) coil arrangement in a typical dynamic driver. For use in this Specification, including the appended claims, the phrase "substantially flat planar" includes a truly planar or flat geometry (e.g., such as the spiral form depicted in FIG. 7D) as well as the geometry that results when, in the context of a coil, each turn of wire is partially overlapped by a number of nearest turns.

The thickness of the wire that forms coil 520 is selected to ensure that, for the anticipated current presented by the electrical (music) signal, the wire will not heat to an unacceptably high temperature. The quantification of "unacceptably high" is a function of the diaphragm material, the glue used to attach the coil to the diaphragm, the electrical insulation/sheathing of the wire, and other factors. For a diaphragm comprising Dupont Co. Tyvek® brand spunbond olefin fiber, a maximum temperature of about 50° C. (122° F.) is considered to be a maximum; for other embodiments, the maximum allowable temperature can be higher as a function of the aforementioned factors. After reading the present disclosure, those skilled in the art will be capable of setting a maximum operating temperature for the wire. Coil 520 comprising wire having a gauge in a range of about 28 to 36 AWG ("American wire gauge") is typically acceptable, as a function of the size of the driver (a larger driver will typically have a coil made from thicker (smaller gauge) wire since it will be required to handle greater current).

The dimensions (both gauge and length) of the wire that composes coil 520, among of parameters, are selected to provide a desired impedance to protect the audio amplifier that is driving audio driver 412. In this regard, in some embodiments, an impedance of 3.6 ohms at DC is selected as the smallest impedance to which the driving amplifier should be exposed. A maximum of 8 ohms is an industry standard as the "maximum" impedance.

In some alternative embodiments, such as those in which the driver is intended to operate at a very high frequency (above the audio band), it is advantageous to design the driver for a very low minimum impedance. In such embodiments, a resistor can be added, for example, in line between the binding posts 410 and coil 520 to increase the total impedance to a suitable value so that an audio amplifier does not experience operational difficulties. Alternatively, a transformer or other impedance converter might be used, as is well known in the art.

Diaphragm 518, with coil 520 attached, is supported by diaphragm support 524, which is depicted in FIG. 7B. Diaphragm support 524 comprises marginal region 734 and has first major surface 735 and second major surface 736. Marginal region 734 defines opening 739. Lower edge 737 of the upper portion of marginal region 734 defines the top of opening 739 and upper edge 738 of the lower portion of marginal region 734 defines the bottom of opening 739. In the illustrative embodiment, opening 739 is not rectangular; in particular, the top of opening 739 is narrower than the bottom of the opening. This is to prevent undesirable diaphragm behavior, such as standing waves, etc. Other shapes for the opening can be used.

Figure 7C:
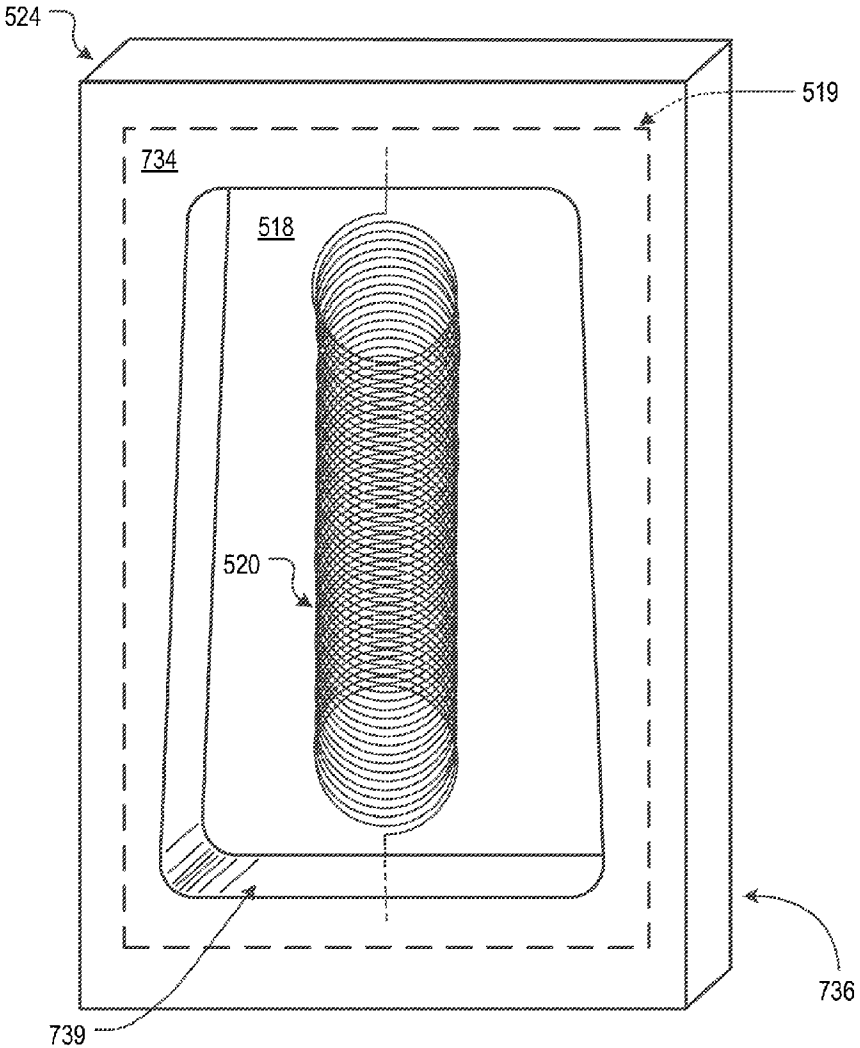
FIG. 7C depicts a back view (from the perspective of FIG. 4) of the diaphragm support with the diaphragm/coil fastened thereto in the audio driver of FIG. 5.

As depicted in FIG. 7C, diaphragm 518 attaches to marginal region 734 of major surface 736 of diaphragm support 524 (i.e., the "back side" in FIG. 7C). In the illustrative embodiment, the side of diaphragm 518 to which coil 520 is attached faces surface 736 of the diaphragm support. That is, coil 520 protrudes slightly into opening 739. Diaphragm 518 is attached at all points along its perimeter 519 so that an air-tight seal is formed between the diaphragm and diaphragm support 524. Diaphragm 518 is fastened to diaphragm support 524 via glue, etc.

Further considerations concerning coil 520 include its positioning on diaphragm 518 as well as the diameter of turns 730 with respect to the width of magnet 514. As to the latter consideration, in the embodiment depicted in FIG. 10, the diameter of turns 730 is slightly greater than the width of magnet 514. This geometry seeks to avoid a very strong line force on diaphragm 518 so as to reduce driver response anomalies (i.e., peaks and dips in SPL across the operating frequency range. As a general rule, the closer the diameter of turns 730 is to the width of magnet 514, the greater the efficiency of driver 412. However, it is possible that a coil diameter that is slightly larger than the perimeter of magnet 514 will yield a maximal force. That diameter can be determined, as desired, by simple experimentation.

Figure 7D:
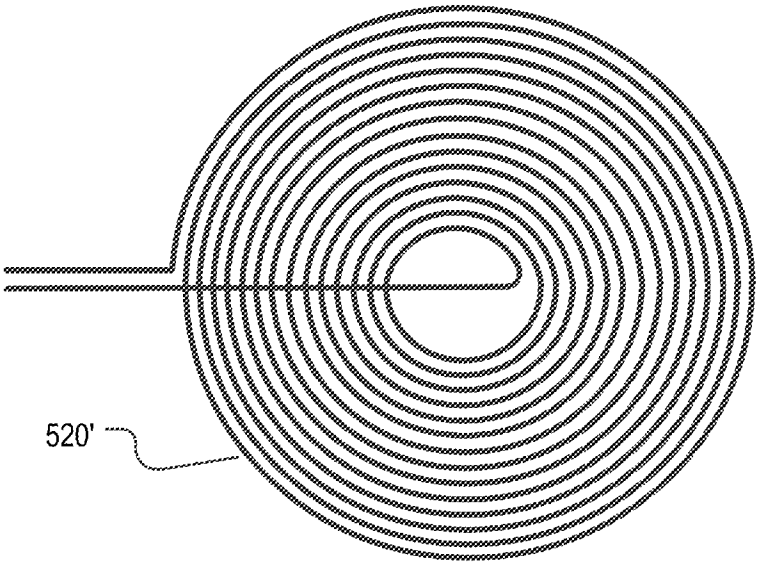
FIG. 7D depicts an alternative embodiment of a coil for use in conjunction with an audio driver in accordance with the present teachings.

FIG. 7D depicts an alternative embodiment of a coil for use in conjunction with driver 412. In this embodiment, rather than arranging the wire in "overlapping" turns 730 as in coil 520, the wire is arranged in a flat "spiral" form in coil 520'. In this embodiment, it is preferable to use a circular (cylindrical) magnet of the same or slightly smaller diameter to coil 520'. This will maximize the interaction area between the magnetic field generated by coil 520 and the magnetic field generated by the magnet.

Figures 8A, 8B:
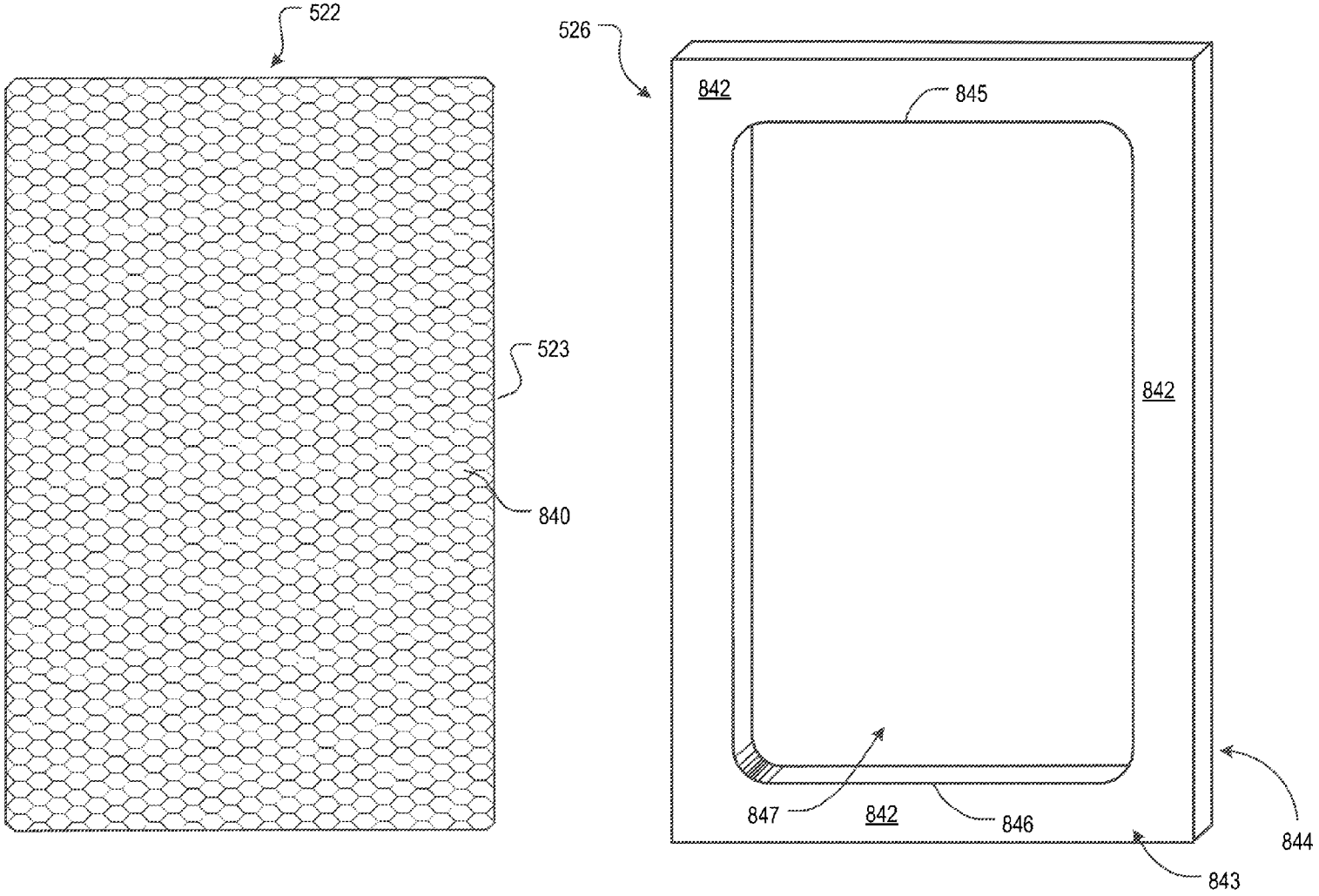
FIG. 8A depicts a view of a major surface of the membrane of the audio driver of FIG. 5.
FIG. 8B depicts a perspective view of a membrane support of the audio driver of FIG. 5.

Returning once again to FIG. 5, and with reference to FIG. 8A, membrane 522 is electrically conductive but non-magnetic (i.e., it is a non mu-metal), such as aluminum, gold, silver, copper, platinum, etc., or combinations thereof. In the illustrative embodiment, membrane 522 has a rectangular shape defined by perimeter 523. In some other embodiments, the membrane has a quadrilateral form other than rectangular, or a polygonal form other than four-sided, a circular form, or an irregular form.

In the illustrative embodiment, membrane 522 comprises a single layer. In some alternative embodiments, the membrane comprises two or more layers. In some of such multi-layer embodiments, at least two of the layers comprise different materials (from one another). In some such embodiments, the materials are selected to provide certain physical properties. For example, in some multi-layer embodiments, at least one layer consists of a material selected for its mechanical strength (e.g., Mylar, etc.) and at least one other layer consists of a material selected for its electrical conductivity.

Membrane 522 is preferably very light weight, such as in the form of a foil. The thickness of the membrane is a factor in determining the operating frequency range of driver 412. Specifically, as the thickness of the membrane increases, it is able to handle more (eddy) current and, as a consequence, can generate a relatively greater sound pressure level ("SPL") at relatively lower frequencies. However, as the thickness and hence mass of the membrane increases, the ability of the membrane to reproduce relatively higher frequencies is compromised due to its increased mass. That is, as membrane thickness increases, the ability to rapidly accelerate and decelerate the membrane decreases. As membrane thickness decreases, driver 412 becomes relatively more efficient at higher frequencies but SPL will suffer at lower frequencies.

A typical and non-limiting range for the thickness of membrane 522 is from about 8 microns to about 20 microns, and more preferably in a range from about 10 microns to about 12 microns, when driver 412 is being used as a tweeter (i.e., reproducing audio frequencies from about 1-2 kHz minimum and about 20 kHz maximum) as opposed to its use for ultrasound transducer applications, wherein the membrane tends to be even thinner (i.e., in a range of about 2 microns to about 5 microns), or when driver 412 is being used as a mid-range driver (i.e., reproducing audio frequencies from about 300 Hz to about 3000 kHz), wherein the membrane tends to be thicker than 10-12 microns.

To prevent standing waves or other anomalous behavior in membrane 522, the membrane has an adaptation that disrupts its otherwise smooth featureless surface. In accordance with the illustrative embodiment, the adaptation is pattern 840, which is impressed all across the surface of membrane 522. In the illustrative embodiment, the pattern is a plurality of hexagonal shaped "cells." In other embodiments, the pattern can be a plurality of other polygons, circles, etc. The pattern can be formed by simply pressing membrane 522 against a surface having the pattern (actually, the "negative" of the pattern) that is to be formed on the surface of the membrane 522.

The choice of material for membrane 522 can affect the "sound" of driver 412 and will also dictate how much (eddy) current is generated in the membrane. Thus, for example, a designer might prefer the sound of driver 412 when membrane 522 comprises pure aluminum. However, if a small amount of copper is added to the aluminum, such as 0.1 to 0.5 weight percent, membrane 522 is capable of supporting more current, which ultimately results in greater driver efficiency and sound pressure level. An additional consideration is that aluminum becomes stiffer and less malleable with the addition of copper, and this is expected to have a small but noticeable audible influence for highly discerning listeners.

Membrane 522 is supported by membrane support 526, which is depicted in FIG. 8B. Membrane support 526 comprises marginal region 842 and has first major surface 843 and second major surface 844. Marginal region 842 defines opening 847. Lower edge 845 of the upper portion of marginal region 842 defines the top of opening 847 and upper edge 846 of the lower portion of marginal region 842 defines the bottom of opening 847.

Figure 8C:
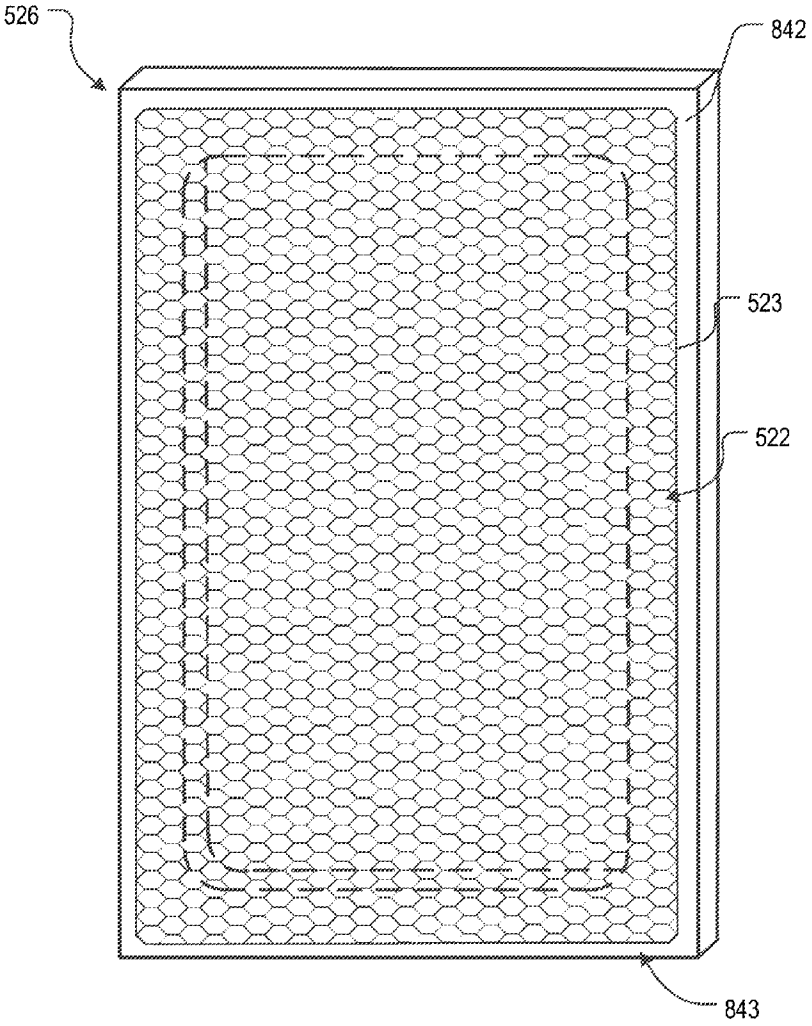
FIG. 8C depicts a back view (from the perspective of FIG. 4) of the membrane support with the membrane fastened thereto in the audio driver of FIG. 5.

As depicted in FIG. 8C, membrane 522 attaches to marginal region 842 of major surface 843 of membrane support 526. Membrane 522 is attached along its perimeter 523, such as by glue, to membrane support 526. This attachment need not be "air-tight."

Figure 9B:
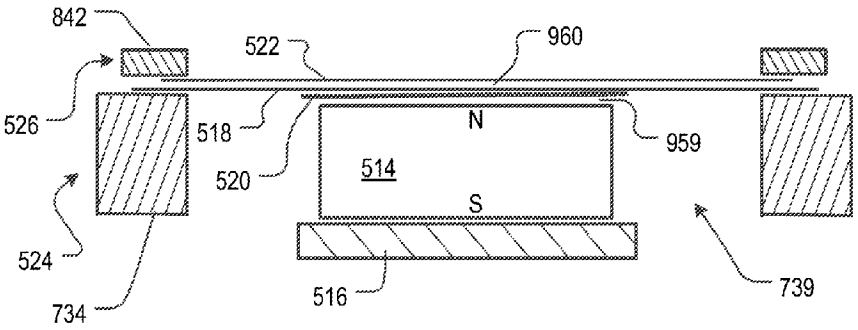
FIG. 9B depicts, via a top sectional view, the audio driver of FIG. 5, after assembly.
Figure 9A:
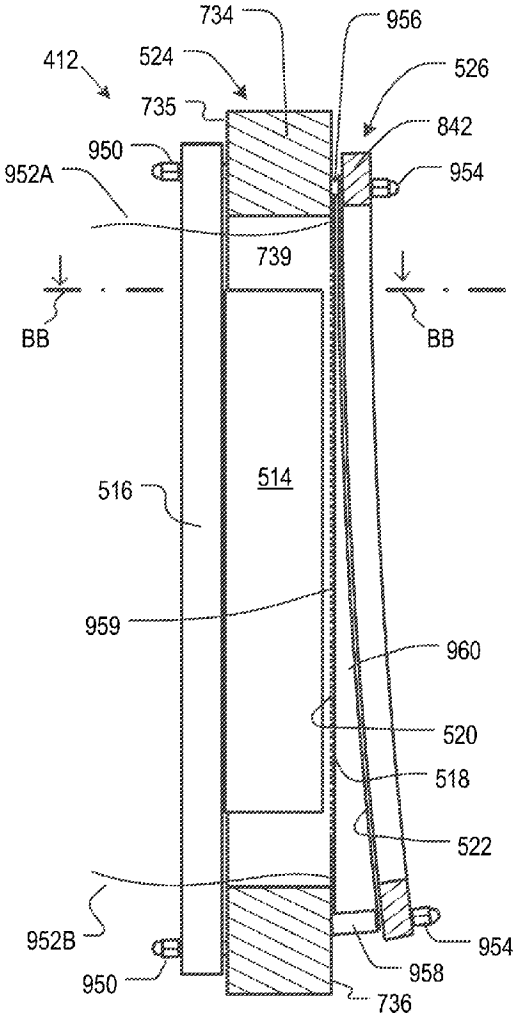
FIG. 9A depicts a side cross-sectional view of the audio driver of FIG. 5, after assembly.

FIG. 9A (side cross-sectional view through line AA in FIG. 4 in the direction shown) and FIG. 9B (top sectional view through the line BB in FIG. 9A in the direction shown) depict the "assembled" driver 412.

As depicted in FIG. 9A, magnet support 516 is attached, via fasteners 950, to the upper and lower portions of side 735 of diaphragm support 524. Membrane support 526 is attached, via pins (not depicted), spacer(s) 956, standoff(s) 958, and fasteners 954, to the upper and lower portions of side 736 of diaphragm support 524. The pins are received by holes (not depicted) in diaphragm support 524. Fasteners 954 couple to the pins.

In embodiments in which driver 412 is intended for use as an audio driver, as in the illustrative embodiment, membrane support 526 diverges from diaphragm support 524. Small spacer 956 is disposed between the upper marginal regions of diaphragm support 524 and membrane support 526. Standoff 958 is disposed between the lower marginal regions of diaphragm support 524 and membrane support 526. Since standoff 958 is taller than spacer 956, membrane support 526 diverges from diaphragm support 524 proceeding toward the location of the standoff. As discussed further below, the divergence is non-linear in the illustrative embodiment.

When assembled, magnet 514 extends into opening 739 of diaphragm support 524 such that the forward surface of the magnet closely approaches coil 520/diaphragm 518. Gap 959 separates the magnet and the coil. In the illustrative embodiment, diaphragm 518 and the forward surface of magnet 514 are substantially parallel (i.e., no more than about a 5% variation from parallel) to one another. Gap 959 is in a range of about 0.5 millimeters (mm) to about 3 mm. The size of gap 959 can affect the overall efficiency of the driver. Yet it is important to ensure that gap 959 is large enough so that coil 520/diaphragm 518 does not impact magnet 514 during operation. Generally, the larger the implementation of audio driver 412 (e.g., larger diaphragm 518, larger membrane 522, etc.) the larger gap 959 must be to avoid contact between coil 520/diaphragm 518 and magnet 514 during operation. Of course, membrane tension can be adjusted to alter excursion.

Figure 10:
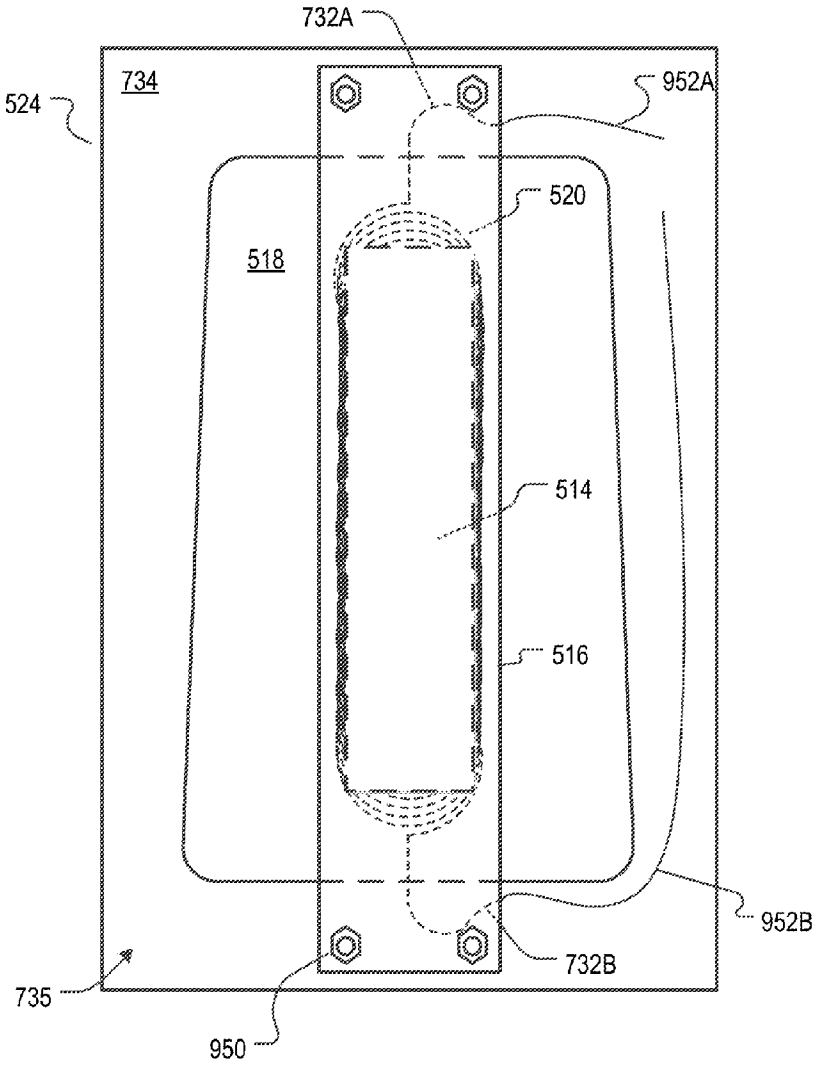
FIG. 10 depicts a back view (from the perspective of FIG. 4) of a portion of the audio driver of FIG. 5, showing the magnet support, magnet, diaphragm, coil, and diaphragm support.

Two leads 952A and 952B comprising electrically conductive material, such as copper or silver wire, etc., are attached to coil 520. Referring also to FIG. 10, which shows a back view (from the perspective of FIG. 4) of some elements of audio driver 412, lead 952A is electrically coupled to "upper" end 732A of coil 520 and lead 952B is electrically coupled to "lower end" 732B of the coil. As discussed further in conjunction with FIG. 11, the leads are also electrically coupled to binding posts 410 (FIG. 4), so that an electrical AC "music" signal delivered to the binding posts can be electrically conducted to coil 520. It is notable that one or more electrical connectors or other electrical components can be situated in-line between the leads and the binding posts as is convenient or otherwise required.

FIG. 10 also depicts magnet support 516 coupled to upper and lower marginal region 734 of surface 735 of diaphragm support 524 via fasteners 950. Magnet 514 and coil 520 are depicted in "phantom" (i.e., "dashed" lines), since from this view, they are obscured by magnet support 516.

Returning to the description of FIGS. 9A and 9B, membrane 522 is situated on the other side of diaphragm 518 (from magnet 514). The diaphragm and membrane are separated by gap 960. In the illustrative embodiment, membrane 522 is not parallel to diaphragm 518; rather, one end of the membrane is relatively closer to the diaphragm and the other end is relatively further therefrom. In the illustrative embodiment, the "top" of membrane 522 is relatively closer to diaphragm 518 and the "bottom" of the membrane is relatively further therefrom.

For audio driver 412 operating as a tweeter (i.e., reproducing a range of audio frequencies from a minimum of about 1-2 kHz to a maximum of about 20 kHz), at its smallest, gap 960 between diaphragm 518 and membrane 522 is in a range of about 0.05 mm (50 microns) to about 0.2 mm (200 microns). At the other end of membrane 522, gap 960 is typically about 8 mm to 12 mm. The foregoing dimensions apply when using a membrane having a thickness that is in the range of 10-12 microns.

It is to be understood that location (i.e., "top" vs. "bottom") wherein gap 960 is relatively smaller or relatively larger is arbitrary; that is, gap 960 could be larger near the top of driver 412 and smaller near the bottom of the driver. Or driver 412 could be rotated ninety degrees so that the gap increases size along a lateral rather than a vertical direction; that is, from right-to-left or left-to-right.

Without being limited to any particular underlying theory of operation, it is believed that the reason why it is desirable for the gap to vary in size is that the more air that is present between the diaphragm and the membrane, the more freely the membrane can move. More particularly, as the frequency of the signal decreases, it is increasingly important for the membrane to be able to move freely. To determine a most desired profile for the gap, a repetitive tuning process can be used wherein a first profile for the gap is established (e.g., with a size for gap 960 at either end selected within the aforementioned range using appropriate sized standoffs, adjustable screws, etc.). Then a "white" noise signal (noise having a broad range of frequencies) is introduced to the driver and SPL versus frequency performance is determined, in known fashion, over the desired frequency range. This can be repeated until a desired performance (e.g., a flat SPL versus frequency response, etc.) is obtained.

FIG. 9A shows that membrane support 526 imparts a curvature to membrane 522, such that, at the upper end, membrane 522 is parallel to diaphragm 518, while, at the lower end, it is at an angle relative to diaphragm 518. This curved profile enables the driver to be tuned to a flat SPL response.

In the illustrative embodiment, the curvature is achieved and the profile thereof is controlled via (1) the relative sizes of small spacer 956 and standoff 958, (2) the relative pressure applied to membrane support 526 by fasteners 954, and (3) the placement of the pin-receiving hole (not depicted) with respect to the end of the membrane support. As to item (3), to the extent that the pin is relatively closer to the end of membrane support 526, relatively less of membrane 522 will be very close to coil 520/diaphragm 518. The determination as to how much of membrane 522 should be close to coil 520/diaphragm 518 is based on achieving a correct SPL at a desired higher frequency, which can be determined via the aforementioned repetitive tuning process.

In some alternative embodiments, the curvature is achieved via a membrane support 526 that is (pre)formed to have a desired curvature. Additional control over the precise shape of membrane support 526 can be achieved by fabricating the membrane support with a non-constant thickness or with a non-constant stiffness, such that its response to the tightening or loosening of fasteners 954 achieves a desired shape.

In some other embodiment, additional standoffs can be used in the region the between the remote ends. This arrangement is used, for example, to create a non-regular profile for the taper of membrane support 526 from one end to the other. This non-regular profile can be used to emphasize (or de-emphasize) certain portions of the frequency spectrum.

In the embodiments discussed thus far, membrane support 526 "bends" along one dimension (i.e., top-to bottom in FIG. 9A). In some additional embodiments (not depicted), membrane support 526 can bend in "two" directions. For example, with reference to FIG. 4, membrane support 526 can be bent "laterally;" that is, from left to right in the drawing. In particular, additional standoffs (not depicted) could be arrayed along the lower marginal region of membrane support 526 (between the existing standoffs) such that profile of the membrane support, and hence membrane 522, would be altered not only from top to bottom, but also from left to right.

In a further embodiment (not depicted), membrane support 526 is pinned toward the central region of its long sides and both ends of the membrane support are lifted via stand-offs, resulting in a cupped profile.

In yet an additional embodiment (not depicted), there are two or more membranes 522, wherein there are gaps between each additional membrane. In still further alternative embodiments, the thickness of membrane 522 can vary along its length. This can be accomplished, for example, by adding one or more extra bands or strips of membrane at various locations along membrane 522. For example, at some distance from one end of the membrane, a width (e.g., 10-50 percent of the length of membrane 522, etc.) of a single additional layer of membrane material is placed on membrane 522. At some further distance along the membrane, a width of two additional layers of membrane material is placed on membrane 522, etc. Varying the thickness of the membrane in this or another fashion will have a similar effect on the driver's SPL-Frequency curve as varying gap 960 between diaphragm 518 and membrane 520. As a consequence, a membrane with an appropriately varying thickness could be positioned substantially parallel to diaphragm 520 yet achieve the same unusually flat SPL versus frequency response performance as the varying gap 960 in the illustrative embodiment.

In still further embodiments (not depicted), there are holes—round or otherwise—in the membrane. Such holes alter the membrane's acoustic properties by allowing air to pass through the holes; they alter the membrane's mechanical properties by reducing the membrane's coefficient of elasticity along directions that pass through the holes; they alter the membrane's dynamical properties by reducing the mass of the membrane where holes are present; and they alter the membrane's electrical properties by interfering with the flow of eddy currents. Those skilled in the art, after reading the present disclosure, will be able to devise patterns of holes that achieve a desired combination of membrane physical parameters (acoustic, mechanical, dynamic, electrical, etc.) to endow the membrane with a desired behavior at different points across its surface.

The foregoing discussion illustrates an important point. Namely, there are a variety of ways to achieve an unusually flat SPL-Frequency response for drivers in accordance with the present teachings. A few such ways have been discussed; those skilled in the art, after reading the present disclosure, will be able to develop other ways to achieve the same end.

In some embodiments, the size of gap 960 can be set to increase the efficiency of a desired frequency band. For example, and without limitation, gap 960 can be adjusted to provide a driver that is intended primarily for human speech (i.e., the driver operates most efficiently for those particular frequencies). Or gap 960 can be adjusted to provide a driver that operates most efficiently at frequencies about 20 kHz, etc. In such applications, membrane 522 will be parallel or more nearly parallel to diaphragm 518 than for 2 kHz to 20 kHz operation. In such applications, the driver will operate with relatively higher efficiency; efficiencies approaching 100 dB at 1 meter with 1 watt of input power are expected. It will be appreciated by those skilled in the art that such embodiments will not exhibit the unusually flat SPL-Frequency response of the illustrative embodiment.

Figure 11:
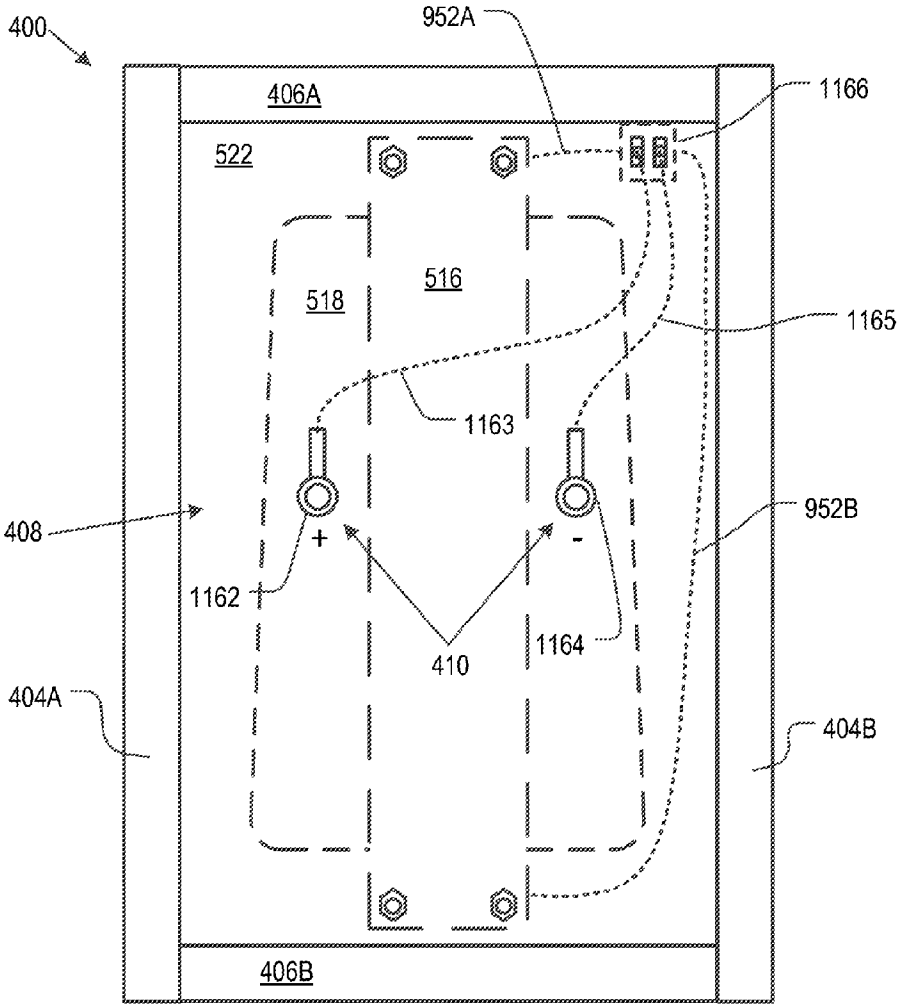
FIG. 11 depicts a back view (from the perspective of FIG. 4) of the audio speaker of FIG. 4, showing speaker binding posts and the electrical coupling to the coil.

FIG. 11 depicts a back view (from the perspective of FIG. 4) of audio speaker 400, showing left side panel 404A, right side panel 404B, top panel 406A, bottom panel 406B, and back panel 408. Binding posts 410, shown individually as "positive" post 1162 and "negative post 1164," extend through back panel 408. Posts 1162 and 1164 are electrically connected, via respective leads 1163 and 1165, to connector 1166. Leads 952A and 952B, which couple to coil 520, are also electrically coupled to connector 1166. In this fashion, an electrical path is provided between binding posts 410 and coil 520.

Figure 12A:
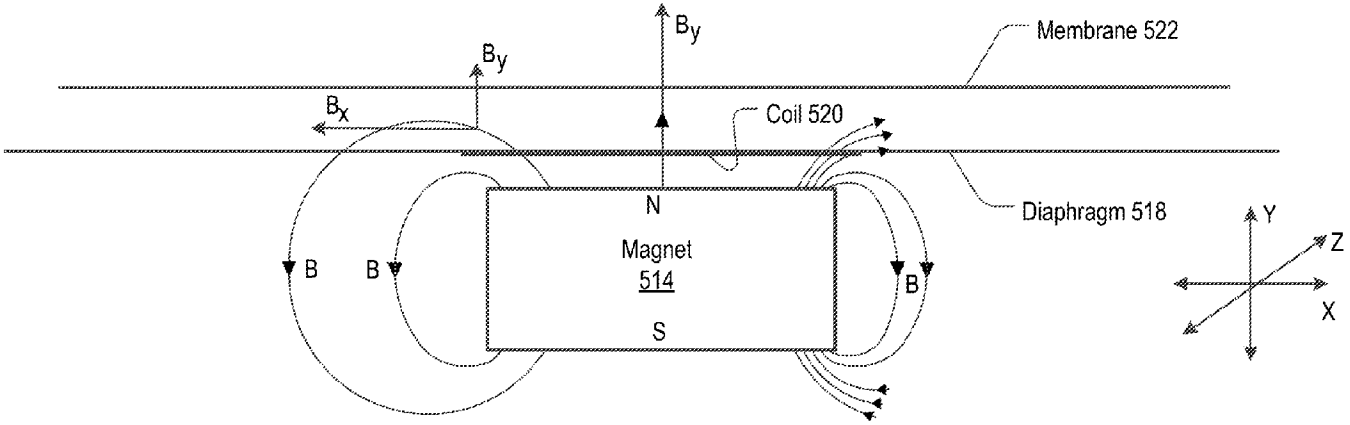
FIG. 12A depicts, via a partial top sectional view, the magnetic field lines emanating from the permanent magnet of the audio driver of FIG. 5.
Figure 12B:
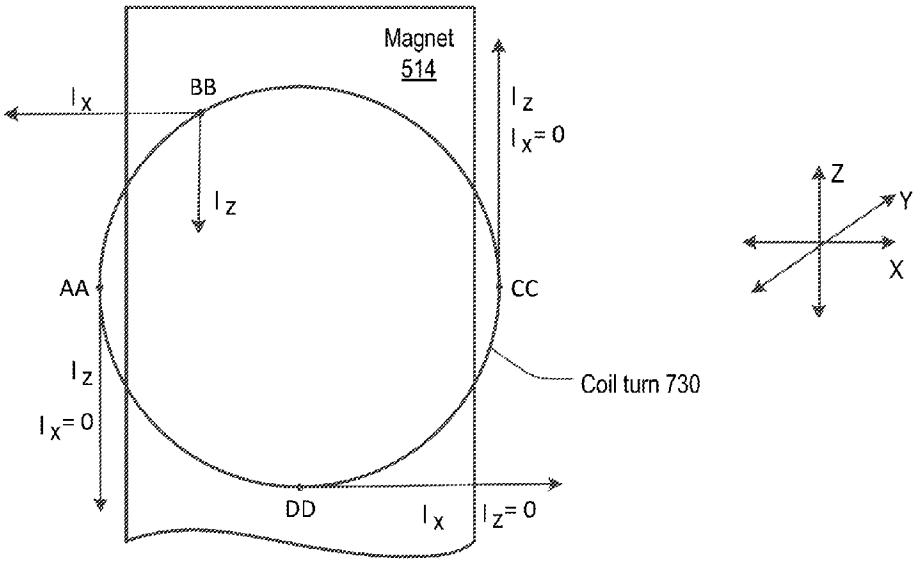
FIG. 12B depicts, via a partial side view, one turn of the coil, and vectors of the current flow through the coil at various locations when the driver is in use.

FIG. 12A depicts a simplified top view of magnet 514, diaphragm 518/coil 520, and membrane 522 and FIG. 12B depicts a simplified front view of magnet 514 and one turn 730 of coil 520. The coordinate system used for these two figures shows "x" directed horizontally (in both figures), "y" is directed vertically in FIG. 12A and "into" or "out of" the page in FIG. 12B, and "z" is "into" or "out of" the page in FIG. 12A and is directed vertically in FIG. 12B.

FIG. 12A depicts illustrative magnetic field lines and vector components thereof for the magnetic field B generated by magnet 514. FIG. 12B depicts current I and vector components thereof for the electrical music signal flowing through turn 730 of coil 520.

The variable current (i.e., the music signal is constantly changing) flowing through any part of the turn 730 that is perpendicular to the "x" direction and in plane with respect to turn 730 (i.e., current vector $I_z$) will interact with the x component of the magnetic field (i.e., field vector $B_x$) generated by magnet 514, thereby resulting in a force that moves diaphragm 518/coil 520 in the "y" direction.

The variable current in the turn 730 of coil 520 will modulate the y component of the magnetic field (i.e., field vector $B_y$) generated by magnet 514. As a consequence, the magnetic field in the y direction will change as a function of the variable current (i.e., the AC music signal) in turn 730 of coil 520. This variation in y component of the magnetic field induces a variable current (i.e., an eddy current) in membrane 522.

The varying current induced in membrane 522 generates a (varying) magnetic field. The magnetic field generated as a consequence of the eddy currents in the membrane interacts with the magnetic field from magnet 514, as modulated by the field generated by the current in turn 730 of coil 520. That interaction generates a force that moves membrane 522 in the "y" direction.

Thus, those skilled in the art will appreciate that vector component $B_x$ of the magnetic field generated by magnet 514 that is parallel to diaphragm 518 is utilized to move the diaphragm while the vector component $B_y$ of the magnetic field generated by magnet 514 that is orthogonal to diaphragm 518 is utilized to move membrane 522.

The forces discussed above are first order and are the primary electromagnetic forces interacting with the movable surfaces. There are, however, higher orders of mutual interaction that, although having little effect on the efficiency of the driver, can have a non-negligible effect on sound quality.

Additional Design Considerations. In terms of its length and width, diaphragm 518 must be large enough to enable coil 520 to move without any restriction and hold the coil firmly in place, but cannot be so large such that any part of the diaphragm can vibrate in reversed phase.

In terms of its length and width, membrane 522 should be large enough to ensure that it is free floating (i.e., under no tension), but small enough so that externally-generated sounds or air currents will, at best, have a marginal impact on the membrane (i.e., cause minimal movement of the membrane).

Based on the foregoing description, those skilled in the art will appreciate that there are a wide number of parameters that can be adjusted to alter the performance of the driver. The effect of these parameters have been previously discussed; some of the parameters that can be adjusted are listed again here:

- The diameter of turns 730 of the coil (with respect to the width of magnet 514);
- The surface coverage of diaphragm 518 by coil(s) 520;
- The gauge and length of the wire composing coil 520;
- The size and strength of magnet 514;
- Magnetic field shape, as adjusted by the location of magnet(s) 514 and the geometry of magnet support 516 and the material used for magnet support 516;
- Membrane 522 material and thickness;
- Size of gap 960 between membrane 522 and diaphragm 518; and
- Variation in the profile (curve) of membrane 522.

A driver in accordance with the illustrative embodiment was fabricated. Sizes and characteristics for the driver included the following:

Diaphragm support (524) dimensions (L, W, T): 170 mm×120 mm×12.5 mm

Diaphragm support opening (739) dimensions (L, Top W, Bot W): 130 mm×80 mm, 70 mm Membrane support (526) dimensions (L, W, T): 160 mm×110 mm×4.7 mm Membrane support opening (847) dimensions (L, W): 120 mm×70 mm Magnet (514): neodymium; N42; 100 mm (L)×25.4 mm (W)×12.7 mm (T)

Coil (520): 30 gauge copper wire; 0.34 ohm/meter; 10.7 m (L); 120 turns with a diameter of about 28 mm Diaphragm (518): Dupont Co. Tyvek® brand spunbond olefin fiber; 0.15 mm (T)

Membrane (522): Aluminum foil, 0.3% copper; 0.012 mm (T)

Gap (959) (magnet-to-coil/diaphragm): 1 mm

Gap (960) (diaphragm-to-membrane): about 0.1 mm (min) and 9 mm (max)

Figure 13:
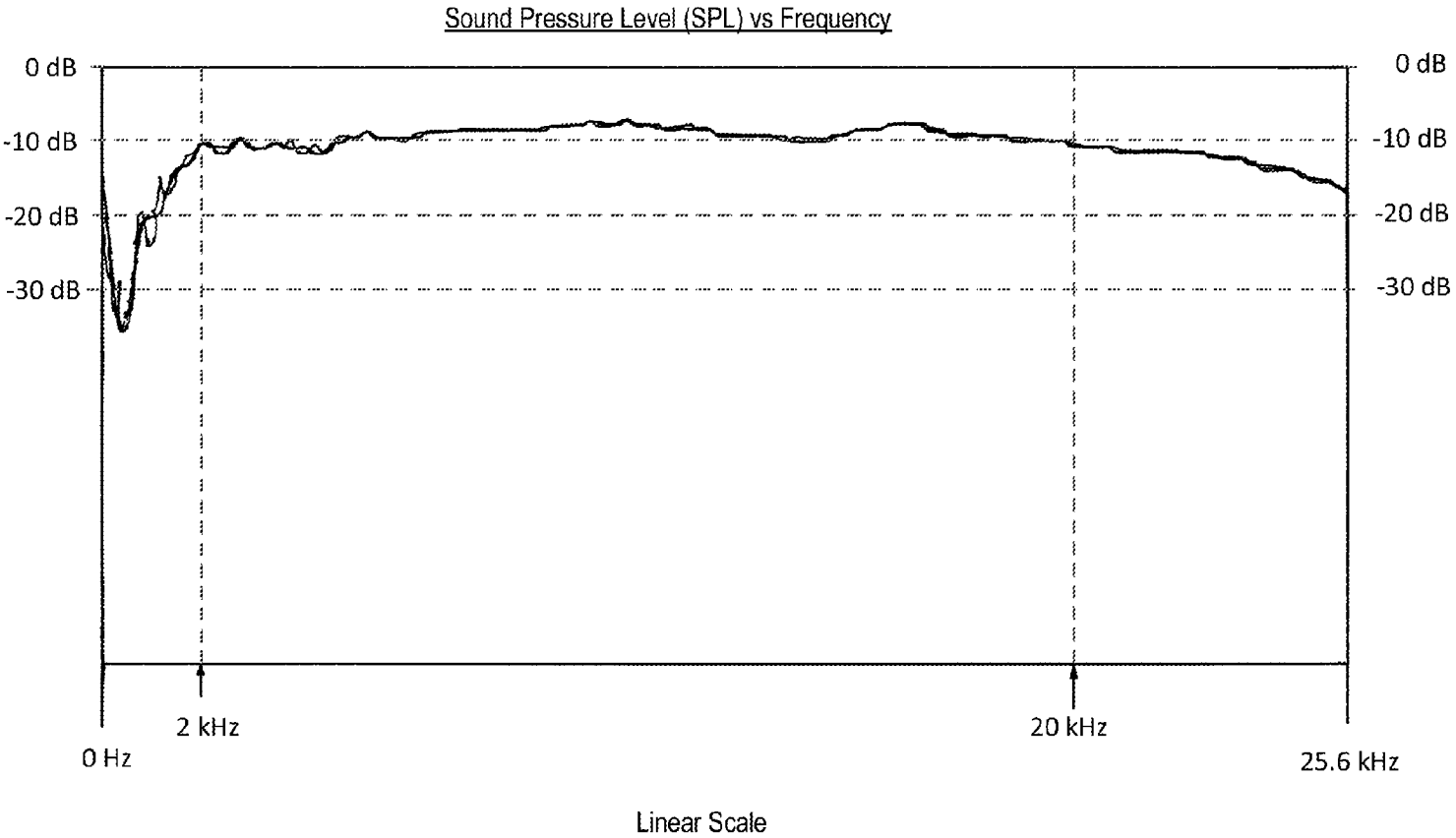
FIG. 13 depicts a plot of Sound Pressure Level as a function of Frequency for a driver in accordance with the illustrative embodiment of the present invention.

FIG. 13 depicts a plot of SPL versus Frequency (linear scale) for the driver referenced above. The measurements were obtained using a Bruel & Kjaer 4133 microphone placed one meter from the driver. The measurements were recorded and analyzed using a Bruel & Kjaer 2032 Signal Analyzer. The response curves shows lines (very close together); one is at maximum frequency resolution and the second line is averaged (as depicted in normal sales literature for drivers). The driver was driven by a white noise signal that was filtered with a 1000 Hz, 24 dB/octave high pass filter.

The plot reveals that the driver, operating as a tweeter, has an unusually flat response, with SPL varying less than about 1.5 dB over the range of 2 kHz to about 20 kHz. It is notable that this performance was obtained at maximum sampling resolution wherein every peak and dip in a signal are present; the signal has not been filtered in any manner. It is evident that the narrow peaks and dips are unusually small being within +/−1 dB. The efficiency was calculated to be 92 dB minimum at 1 meter at 1 watt input power. The distortion for any frequency above 2 kHz was less than 0.1 percent.

Figure 14:
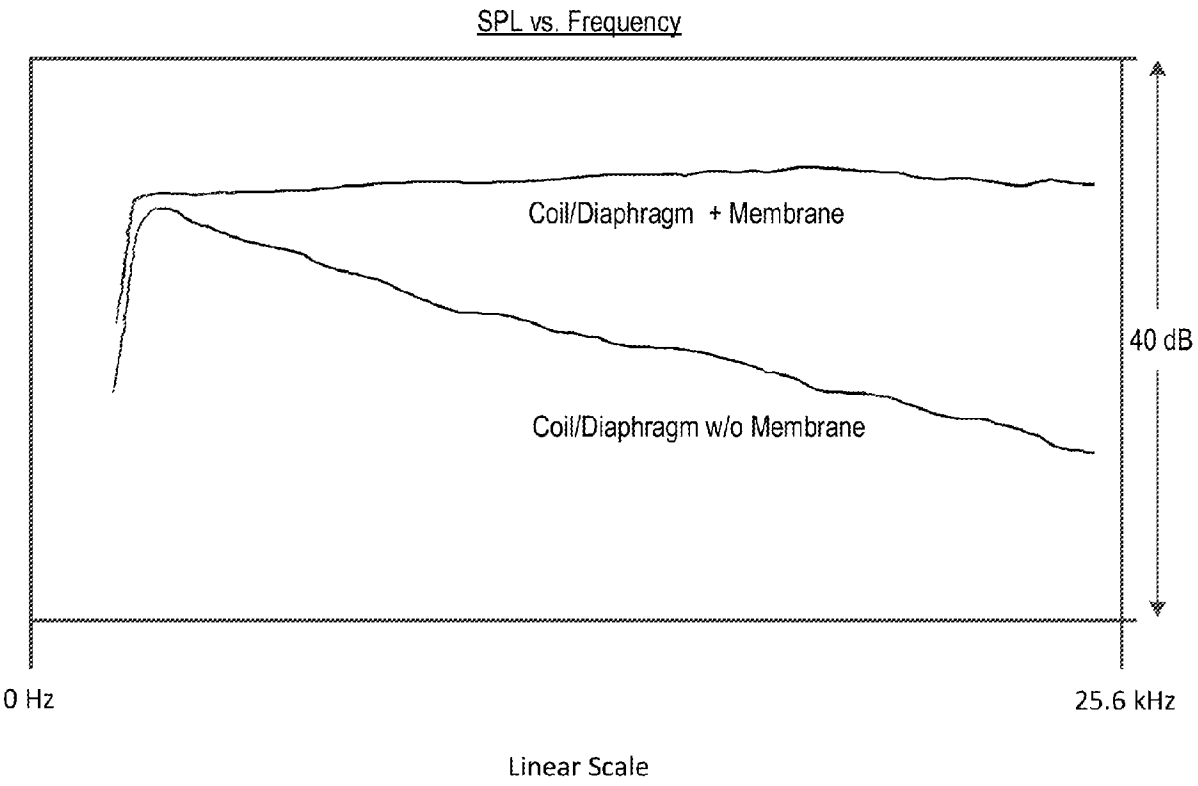
FIG. 14 depicts plots of Sound Pressure Level as a function of Frequency for two audio drivers: one including a coil/diaphragm and membrane in accordance with the illustrative embodiment of the present invention and the other using only a coil/diaphragm but no membrane.

FIG. 14 depicts two SPL versus Frequency plots, one for a driver in accordance with the illustrative embodiment and a second plot for a driver made in accordance with the present teachings except that the membrane was omitted. The plots indicate that at relatively lower frequencies (2 kHz), most of the output is being generated by the diaphragm. Indeed, for these designs, with the addition of the membrane, the SPL increases from about 30 dB to about 32 dB at 2 kHz. On the other hand, at 20 kHz, the SPL increases from about 15.5 dB to about 32 dB at 20 kHz with the addition of the membrane.

Figure 15:
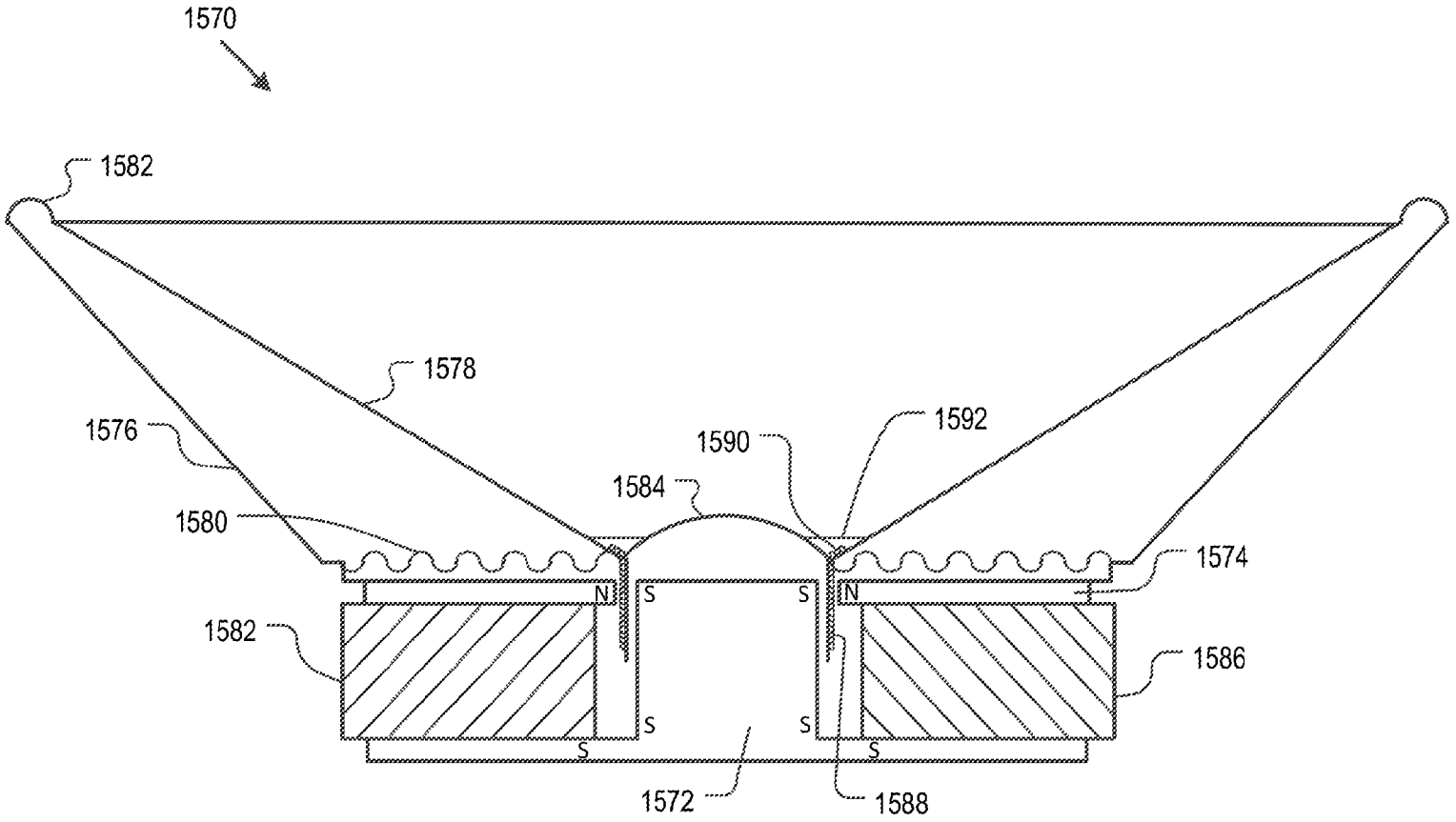
FIG. 15 depicts a modified dynamic driver in accordance with the present teachings.

FIG. 15 depicts a modified dynamic driver 1570 in accordance with an embodiment of the invention. Driver 1570 has all of the elements of a conventional dynamic driver, including pole piece 1572, top plate 1574, rigid basket 1576, diaphragm or cone 1578, spider 1580, surround 1582, dust cap 1584, magnet 1586, and voice coil 1588, arranged as shown. As these elements are well known in the art, the will not be discussed in detail here.

Briefly, diaphragm 1578 is connected to rigid basket 1576 by spider 1580, which is a flexible suspension element. The spider constrains voice coil 1588 to move axially through a cylindrical gap formed between pole piece 1572 and magnet 1586. When an electrical signal is applied to voice coil 1588, a magnetic field is created by the electric current flowing therein, such that the voice coil functions as a variable electromagnet. The field generated by voice coil 1588 and the field generated by permanent magnet 1586 interact, generating the Lorentz force. This force causes voice coil 1588, and attached diaphragm 1578 to move back and forth, thereby reproducing sound under the control of the applied electrical signal coming from an amplifier.

Unlike conventional dynamic drivers, driver 1570 includes membrane 1592 as well as an additional portion of voice coil that extends beyond diaphragm 1578. Membrane 1592, which in this embodiment is ring shaped, is attached (e.g., glue, etc.) between dust cap 1584 and diaphragm 1578. In the embodiment depicted in FIG. 15, membrane 1592 is significantly smaller (has less surface area) than diaphragm 1578. As a consequence, membrane 1592 will have less of an impact on the overall sound and performance of modified dynamic driver 1570 than for driver 412, the variant of a planar magnetic driver.

It is to be understood that although the disclosure teaches several implementations of the illustrative embodiment, many variations can easily be devised by those skilled in the art after reading this disclosure and that the scope of the present invention is to be determined by the following claims.

What is claimed:

1. An apparatus including a first driver that transforms an electrical signal into air movement, wherein the first driver comprises:

a source of a non-varying magnetic field;

a first movable surface, wherein the first movable surface comprises an electrically insulating, non-magnetic material;

a coil comprising a substantially flat planar arrangement of an electrically conductive material, wherein the coil is disposed on the first movable surface and the first movable surface is directly driven thereby;

a first gap between the source of a non-varying magnetic field and the first movable surface;

a second movable surface spaced apart from the first movable surface by a second gap, wherein the second movable surface comprises an electrically conductive, non-magnetic material, and wherein:

(a) the second movable surface is not directly driven;

(b) the second gap is not sealed; and (c) the air movement results from movement of the first movable surface and the second movable surface.

2. The apparatus of claim 1 wherein the first movable surface and the second movable surface are suspended independently from one another and are not physically coupled to one another.

3. The apparatus of claim 1 and further wherein the first movable surface is a flat planar surface.

4. The apparatus of claim 1 and further wherein:

(a) the first movable surface has a first end and a second end;

(b) the second movable surface has a first end proximal to the first end of the first movable surface and a second end proximal to the second end of the second movable surface;

(c) the second gap has a first size proximal to the first end of the first and second movable surfaces and a second size proximal to the second end of the first and second movable surfaces; and (d) the second movable surface diverges from the first movable surface such that the first size of the second gap is different from the second size of the second gap.

5. The apparatus of claim 4 wherein the second movable surface diverges from the first movable surface non-linearly.

6. The apparatus of claim 1 and further wherein the first movable surface is disposed between the source of the non-varying magnetic field and the second movable surface.

7. The apparatus of claim 1 wherein the source of the non-varying magnetic field is a permanent magnet, and further wherein, when the first driver is in a quiescent state, the first movable surface is substantially parallel to a facing surface of the permanent magnet such that the first gap has a uniform size and the second movable surface is not parallel to the first movable surface, the second gap having a non-uniform size and a monotonic profile.

8. The apparatus of claim 1 wherein the second surface is a foil and comprises, as a major component, aluminum.

9. The apparatus of claim 1 wherein the second movable surface comprises a physical adaptation for preventing standing waves.

10. The apparatus of claim 1 and further comprising:

an enclosure, wherein the first driver is disposed at least partially in the enclosure; and speaker terminals, wherein the speaker terminals are accessible at an exterior of the enclosure to electrically couple to speaker wire that delivers an electrical signal thereto, and further wherein the speaker terminals are electrically coupled to the coil of the first driver.

11. The apparatus of claim 10 and further comprising a second driver, wherein the second driver is a dynamic driver.

12. An apparatus including a driver that transforms an electrical signal into air movement, wherein the driver comprises:

a magnet; and a first surface and a second surface, wherein:

(a) a first gap is defined between the magnet and the first surface;

(b) a second gap is defined between the first surface and the second surface;

(c) the first surface and the second surface are movable;

(d) the first surface comprises an electrically insulating material, has an electrically conductive coil comprising a substantially flat planar arrangement of one more wires disposed thereon, and is directly driven to movement by an electrical signal during operation of the driver, wherein the movement results from an electromagnetic interaction between a magnetic field of the magnet and a magnetic field generated by the electrical signal flowing through the electrically conductive coil;

(e) the second surface, which comprises an electrically conductive, non-magnetic material, is not directly driven; and (f) when the driver is in a quiescent state, the first surface is substantially parallel to a facing surface of the magnet such that the first gap has a uniform size and the second surface is not parallel to the first surface, the second gap having a non-uniform size that tapers monotonically.

13. The apparatus of claim 12 wherein the first surface and the second surface are disposed on a first side of the magnet.

14. The apparatus of claim 12 wherein the first surface is a flat planar surface consisting essentially of a material selected from the group consisting of a plastic and a cellulosic material.

15. The apparatus of claim 13 wherein the electrically conductive coil is disposed on a side of the first surface that faces the magnet.

16. The apparatus of claim 12 wherein when the driver is in the quiescent state:

(a) a size of the first gap is greater than a first size of the second gap near a first end thereof;

(b) the size of the first gap is smaller than a second size of the second gap near a second end thereof.

17. The apparatus of claim 12 and further wherein the second surface is a foil consisting essentially of aluminum.

18. The apparatus of claim 12 and further wherein the second surface is a foil and comprises, as a major component, aluminum, and as a minor component, copper.

19. The apparatus of claim 12 wherein the taper is non-linear.

20. A method for transforming an electrical signal into air movement, the method comprising: generating a varying magnetic field by passing a varying electrical current through a substantially flat planar coil of wire disposed on a first surface, wherein the first surface is not electrically conductive and is non-magnetic; interacting the varying magnetic field with a non-varying magnetic field, wherein there is a gap between a source of the non-varying magnetic field and the first surface; and generating eddy currents in a second surface by exposing the second surface, which is electrically conductive and non-magnetic, to the non-varying magnetic field as modulated by the varying magnetic field, wherein the air movement results from: (a) movement of the first surface, due to interaction of the of the varying magnetic field with the non-varying magnetic field; and (b) movement of the second surface, due, at least in part, from interaction of a magnetic field generated by the eddy currents with the non-varying magnetic field and the varying magnetic field.

21. The apparatus of claim 1 wherein relative contributions of the first movable surface and the second movable surface to the air movement generated thereby varies as a function of frequency of the electrical signal and as a function of distance between the first movable surface and the second movable surface.

22. The apparatus of claim 21 wherein, when operating as a tweeter for reproducing, as sound, frequencies of the electrical signal in a range between about 2 kHz and 20 kHz:

at relatively lower frequencies of the electrical signal, movement of the first movable membrane causes relatively more of the air movement than movement of the second movable membrane; and at relatively higher frequencies of the electrical signal, movement of the second movable membrane causes relatively more of the air movement than movement of the first movable membrane.

23. The apparatus of claim 1 wherein the source of the non-varying magnetic field is a permanent magnet, and further wherein, when the first driver is in a quiescent state, the first movable surface is substantially parallel to a facing surface of the permanent magnet such that the first gap has a uniform size and the second movable surface is parallel to the first movable surface such that the second gap has a uniform size.

* * * * *